US007417656B1

(12) United States Patent
Holzschuh et al.

(10) Patent No.: US 7,417,656 B1
(45) Date of Patent: Aug. 26, 2008

(54) COMPACT PRINTER

(75) Inventors: Timothy S. Holzschuh, Littleton, CO (US); John A. Tomasik, Littleton, CO (US)

(73) Assignee: Cognitive Solutions, Inc., Golden, CO (US)

( * ) Notice: Subject to any disclaimer, the term of this patent is extended or adjusted under 35 U.S.C. 154(b) by 39 days.

(21) Appl. No.: 11/567,638

(22) Filed: Dec. 6, 2006

Related U.S. Application Data

(60) Provisional application No. 60/748,070, filed on Dec. 6, 2005.

(51) Int. Cl.
*B41J 33/00* (2006.01)
*B41J 2/325* (2006.01)

(52) U.S. Cl. ..... 347/177; 347/217

(58) Field of Classification Search ..... 347/212, 347/213, 217, 218, 177, 220, 222
See application file for complete search history.

(56) References Cited

U.S. PATENT DOCUMENTS 3,998,153 A 12/1976 Erhardt et al.
4,025,830 A 5/1977 Delaporte
4,261,039 A 4/1981 Baker et al.
4,440,977 A 4/1984 Pao et al.
4,884,904 A 12/1989 Berquist
5,092,688 A 3/1992 Haennelt et al.

(Continued)

OTHER PUBLICATIONS

DYMO, "Laser Writer Twin Turbo", retrieved from http://global.dymo.com/enUS/Products/LabelWriter_Twin_Turbo.html on May 26, 2006, 2 pages.

(Continued)

*Primary Examiner*—K. Feggins
(74) *Attorney, Agent, or Firm*—Sheridan Ross P.C.

(57) ABSTRACT

A compact printer that includes a sensor system for monitoring the position and/or status of media is provided. The system includes a photo source extending along a line across all or a portion of the width of a media path. The photo source can comprise a number of sources, such as a number of focused LED sources. A single detector or receiver is disposed on a side of the media path opposite the source. The location of the single receiver with respect to the width of the media path can be adjusted by a user. Information related to the intensity of light received at the receiver is passed to a controller, which can use the information to generate a media out signal or to determine the location of an index mark.

20 Claims, 17 Drawing Sheets

U.S. PATENT DOCUMENTS

| | | | |
|---|---|---|---|
| 5,123,760 | A | 6/1992 | Tsuru et al. |
| 5,483,624 | A | 1/1996 | Christopher et al. |
| 5,486,259 | A | 1/1996 | Goodwin et al. |
| 5,538,351 | A | 7/1996 | Miyano |
| 5,594,838 | A | 1/1997 | Christopher et al. |
| 5,805,779 | A | 9/1998 | Christopher et al. |
| 5,833,800 | A | 11/1998 | Goodwin et al. |
| 6,019,527 | A | 2/2000 | Green |
| 6,158,342 | A | 12/2000 | Moore |
| 6,163,538 | A | 12/2000 | Brown et al. |
| 6,203,221 | B1 | 3/2001 | Tomasik et al. |
| 6,386,775 | B1 | 5/2002 | Hamisch, Jr. et al. |
| 6,533,476 | B2 | 3/2003 | Hamisch, Jr. et al. |
| 6,712,112 | B2 | 3/2004 | Goodwin et al. |
| 6,805,183 | B2 | 10/2004 | Goodwin et al. |
| 7,277,109 | B2 * | 10/2007 | Ueda ..... 347/177 |
| 2002/0033875 | A1 * | 3/2002 | Soshi ..... 347/217 |
| 2005/0157156 | A1 * | 7/2005 | Chiang ..... 347/213 |
| 2006/0098083 | A1 * | 5/2006 | Huang ..... 347/220 |

OTHER PUBLICATIONS

DYMO, "DYMO Stamps compatible LabelWriter Printers", retrieved from http://global.dymo.com/enUS/Categories/DYMO_Stamps_compatible_LabelWriter_Printers.html on May 26, 2006, 3 pages.

DYMO, "Makers of LabelWriter Label Printers, Electronic Labelmakers and the Original...", retrieved from http://global.dymo.com/enUS/Home/default.html, 1 page.

* cited by examiner

COMPACT PRINTER

CROSS-REFERENCE TO RELATED APPLICATIONS

This application claims the benefit of U.S. Provisional Application No. 60/748,070, filed Dec. 6, 2005, the entire disclosure of which is hereby incorporated herein by reference. This application is related to U.S. patent application Ser. No. 11/567,659, filed Dec. 6, 2006, entitled "Compact Printer".

FIELD

The present invention relates to printer devices.

BACKGROUND

Printers are commonly used to produce hard copy output in a variety of situations. One type of printer is the thermal printer. A thermal printer may operate as a direct thermal printer, in which images are formed on a specially treated paper or other media by applying heat directly to the surface of the media. Another type of thermal printer is the thermal transfer printer, in which an image is formed by applying heat to a ribbon, which causes the transfer of wax and/or resin from the ribbon to the media. In addition, thermal printers that are capable of operating as direct thermal or thermal transfer devices are available.

Corresponding to the two main types of thermal printer technologies, there are two main categories of thermal printer media; media adapted for use in direct thermal printers and media adapted for use in thermal transfer printers. Media adapted for use in a direct thermal printer is specially treated. In particular, media for direct thermal printers typically has a coating that changes color as heat is applied. Accordingly, no ribbon is required. However, the media has a relatively short shelf life. In addition, the image produced by the print process is limited to the capabilities of the media. Also, the media is sensitive to degradation from exposure to heat, the outdoors, or other harsh environments. Media that is adapted for use in connection with thermal transfer printers must receive ink that has been released from a print ribbon using heat. Accordingly, such media is generally adapted to have good ink receptivity. However, the media itself is not heat sensitive. As a result, the media has a relatively long shelf life. In addition, the color of the output is not as limited as for direct thermal printers. Where a thermal transfer process is used, it is desirable to control tension in the print ribbon in order to ensure acceptable print quality. Also, it is desirable to monitor the amount of unused print ribbon that remains available. However, the ability to maintain ribbon tension and to monitor remaining print ribbon has been limited.

Media comprises a substrate on which the image is formed. Media for thermal printers, whether direct thermal or thermal transfer, may comprise a substrate made from a variety of materials, such as paper, films, or foils. In addition, the substrate of the media may be either unsupported or pressure sensitive. Unsupported substrate refers to any substrate that does not have a backing. A pressure sensitive substrate typically comprises a label adhered to a backing.

Examples of applications in which thermal printers have become prevalent include the ski industry, which commonly uses thermal printers to produce tickets at the point of sale on a durable label media. Another example is automotive service labeling, in which reminder labels for oil changes or other periodic maintenance procedures may be printed out on demand and placed in a customer's windshield. Examples of general business applications that use thermal printers include archive data labeling, asset inventory tracking, retail pricing, and media record tracking. Another example is the health care industry which uses thermal printer technology in connection with laboratory sample identification, patient identification, pharmacy labeling, x-ray tracking, etc. In addition to including textual information or graphics, labels often include machine-readable barcodes.

Depending on the use of the output being produced by the thermal printer, output of different sizes may be desirable. Most thermal printers use rolls of media. Accordingly, media comprising an unsupported substrate can be cut to an appropriate length after printing, either manually or automatically. Therefore, a thermal printer loaded with media having an unsupported substrate can produce output on pieces of media having different lengths without requiring that the media be changed. However, producing an output on media of a different width requires that the media loaded into the printer be changed, or that a different printer with media of the desired width already loaded be used. For media comprising labels, perforations and/or pre-printed matter, it is important to ensure that the media is properly registered with respect to the print head. Also, such registration should be easily established and reliably maintained for a variety of media widths. The task of establishing and maintaining proper registration is complicated where a user desires to load media of different widths at different times in a printer. For example, mechanisms for indexing print media have typically required that a user register an optical source and an optical sensor with one another and with indexing marks on the media. As a result, the indexing of print media has often been unreliable and difficult.

In addition to being available in different types and widths, media is available in different roll sizes. For example, rolls of relatively large diameter are desirable for stationary applications where large print volumes are anticipated. Smaller rolls can be used where print volumes for that media are relatively small or where it is desirable to use a compact printer. However, printers have been limited in their ability to accommodate media rolls of different sizes. In particular, compact printers have been unable to accommodate relatively large roll sizes. As a result, the ability to use a wide range of media roll sizes has been limited to relatively large, mid-range or industrial printers.

Thermal printers typically provide heat to the media and/or print ribbon using a plurality of elements spread across the media supply path as part of a print head. By way of illustration, a line across the width or most of the width of a piece of media can be formed by energizing the elements simultaneously for an instant of time. A line along the length of the media can be formed by energizing a single element (or a number of adjacent elements to produce a thicker line) for a period of time as the media is moved past the print head. Because individual elements of a print head can fail at different times, operators often accept diminished output quality rather than incurring the expense of replacing the entire print head. Therefore, it would be desirable to provided undiminished (or less diminished) print quality even when one or a few print elements have failed. It also would be desirable to detect print elements that are in the process of failing, so that remedial action can be taken.

SUMMARY

The present invention is directed to solving these and other problems and disadvantages of the prior art. Furthermore, embodiments of the present invention are directed to compact thermal printers having features normally associated with larger printer platforms.

In accordance with embodiments of the present invention, a method and apparatus for monitoring the position of media within a printer are provided. Such embodiments may include an array of light sources that extend across all or a portion of the width of the media path. Opposite the array of sensors, on the other side of the media path, is a detector. The location of the detector can be selected by the user so that it is adjacent indexing marks provided as part of the print media. Accordingly, the position of media and in particular of print stock having features such as adhesive labels, perforations or preprinted matter that should be registered with printed matter can be monitored.

Printers in accordance with other embodiments of the present invention may be provided with a mechanism for maintaining the tension of a ribbon used in thermal transfer applications or modes. In particular, a clutch mechanism is provided as part of the supply spindle assembly. A clutch mechanism is also provided as part of the take-up spindle assembly. By allowing for movement of the supply and take-up spindles relative to one another, appropriate tension may be maintained in the ribbon. Moreover, appropriate tension may be maintained regardless of the direction or amount of ribbon movement.

In accordance with still other embodiments of the present invention, continuous monitoring of the print ribbon supply may be performed in connection with thermal transfer printing. In particular, the amount of print ribbon remaining on a print ribbon supply roll may be determined by the frequency or revolutions per minute (rpm) at which the supply roll rotates as the print ribbon is drawn from the supply roll. The frequency of the supply roll can be detected using an optical source and an optical interrupter in combination with a photosensor to provide a pulsed signal indicative of the supply roll rpm.

In accordance with embodiments of the present invention, a method and apparatus for detecting the resistance of elements of the print head are provided. In particular, the resistance of individual print head elements is monitored to determine whether special procedures are required. Such special procedures may include label format position adjustment to bypass a failed print head element to enable continued use of a print head, without print head replacement, removal or down time. Alternatively or in addition, special procedures may include applying a longer on time duration to weak or failing elements to compensate for lower energy transfer from such elements.

In accordance with embodiments of the present invention, a printer capable of accommodating print stock or media rolls of different sizes is provided. Such embodiments include a printer enclosure having features that allow print stock rolls having dimensions that exceed the nominal capacity of the printer to be accommodated. More particularly, panels comprising portions of the printer enclosure can be placed in at least first or second configurations. In the first configuration a relatively small print stock roll can be accommodated within the confines of the enclosure. In the second configuration, panels of the enclosure are opened to allow a relatively large print stock roll to be held such that at least some of the print stock roll extends beyond the normal confines of the enclosure.

Additional features and advantages of embodiments of the present invention will become more readily apparent from the following discussion, particularly when taken together with the accompanying drawings.

DETAILED DESCRIPTION

Figure 1:
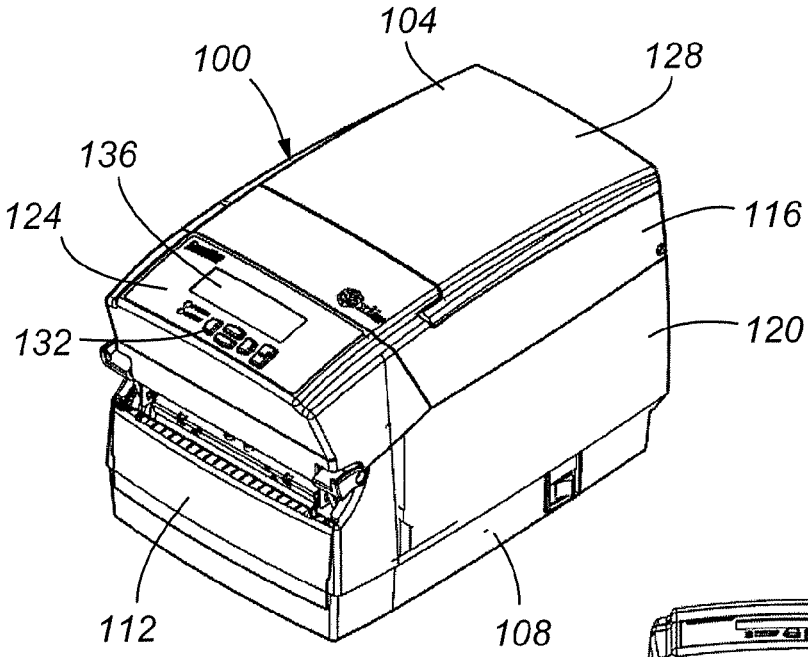
FIG. 1 is a perspective view of a printing apparatus in accordance with embodiments of the present invention.

FIG. 1 is a perspective view of a printer 100 in accordance with embodiments of the present invention. The illustrated printer 100 includes an enclosure or housing 104 comprising a base 108, front panel 112, cover 116, sidewall 120, and user interface assembly 124. For user input the user interface assembly 124 may feature buttons 132. Indicator lights and/or a display panel 136 may provide user output. The cover 116 may include a top panel or top media cover 128 that is moveable to accommodate relatively large rolls of print media, also referred to herein as print stock rolls. In general, the printer 100 may be used to print or encode information on print media, including but not limited to direct thermal or thermal transfer labels, tags, wrist bands, static labels, and receipt paper.

Figure 2:
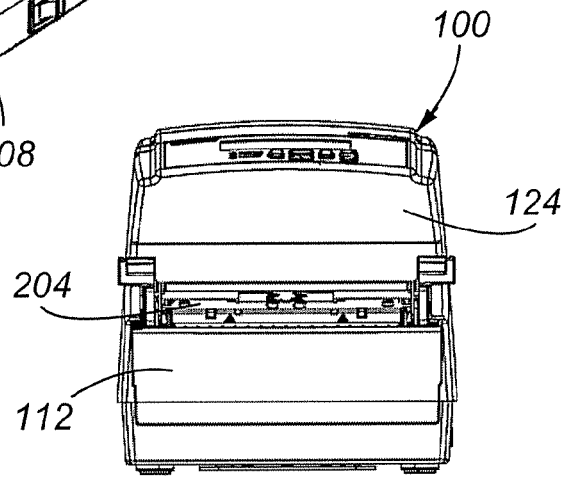
FIG. 2 is a front end view of a printing apparatus in accordance with embodiments of the present invention.
Figure 3:
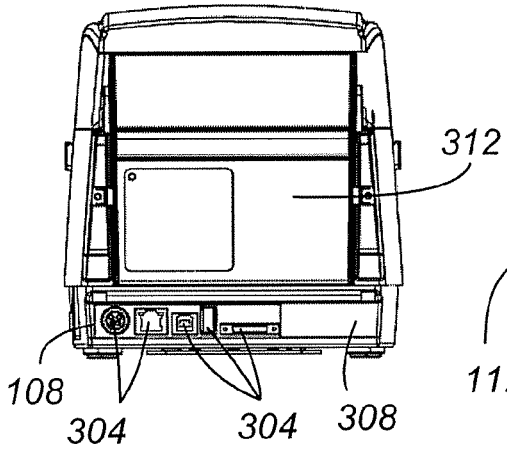
FIG. 3 is a back end view of a printing apparatus in accordance with embodiments of the present invention.

The printer 100 is shown in front, rear, and side elevation views in FIGS. 2, 3, and 4A-B respectively. As shown in FIG. 2, a print head or printer assembly 204 may be located generally below the user interface 124. Interface ports 304 may be provided that are accessible from the exterior of the enclosure 104, for example in a rear surface 308 of the base 108, as illustrated in FIG. 3. In addition, a back panel or media cover 312 that is moveable to accommodate relatively large print stock rollers may be provided.

Figure 4A:
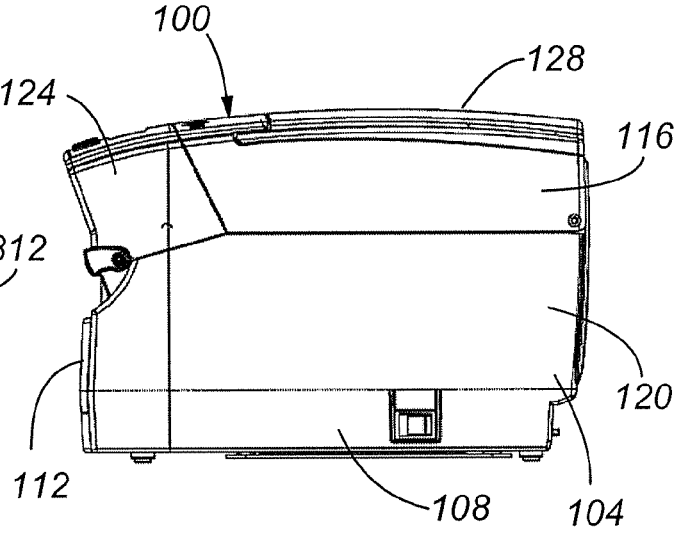
FIG. 4A is a right side view of a printing apparatus in accordance with embodiments of the present invention.
Figure 4B:
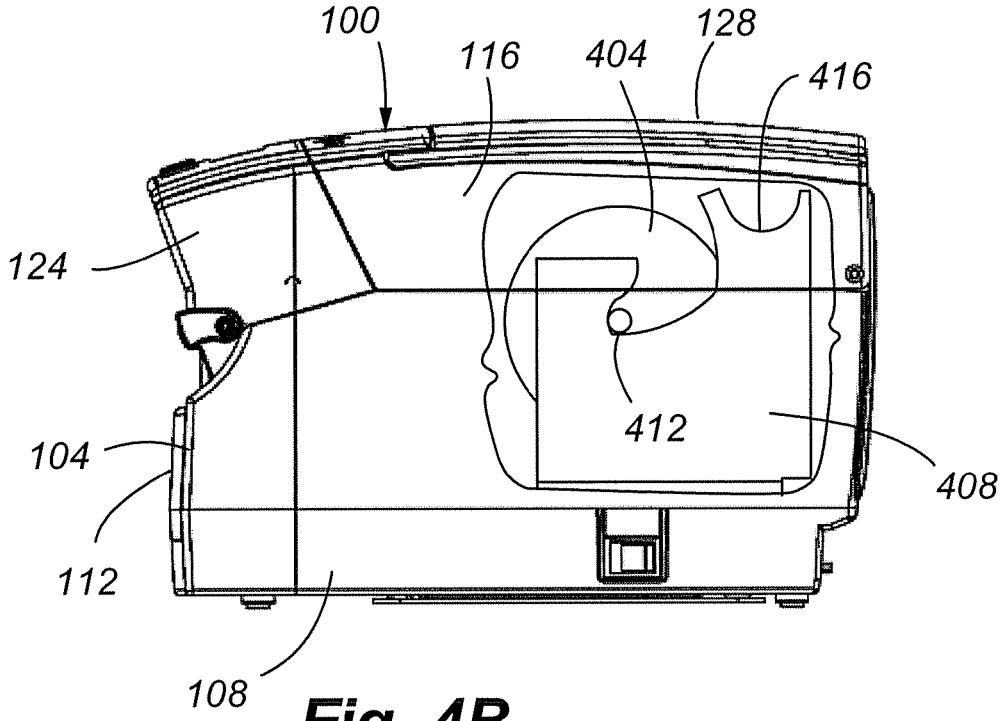
FIG. 4B is a partially cutaway view of the printing apparatus of FIG. 4A.

In FIGS. 4A-B the printer 100 is shown with the top panel 128 and the back panel 312 in a closed configuration, such that the panels 128 and 312 are generally flush with the adjacent surfaces of the enclosure 104. In this closed configuration, the enclosure 104 is capable of receiving a roll of print stock of up to a first size. With particular reference to FIG. 4B, the enclosure 104 is partially cutaway to show the location of such a print stock roll 404 within the enclosure 104. In accordance with embodiments of the present invention, this first size may be a size that is typically associated with compact desktop printers. For example, this first size of print stock roll may have a maximum roll outer diameter of five inches or less. As also shown in FIG. 4B, embodiments of the present invention may include a two-position or bay print stock roll carrier or bracket 408. In particular, it can be seen that a print stock roll 404 of no greater than the first size can be placed in the first bay 412 of the print stock roll carrier 408. The second bay 416 of the print stock roll carrier 408 is typically empty when the first bay 412 is holding a print stock roll 404.

Figure 8B:
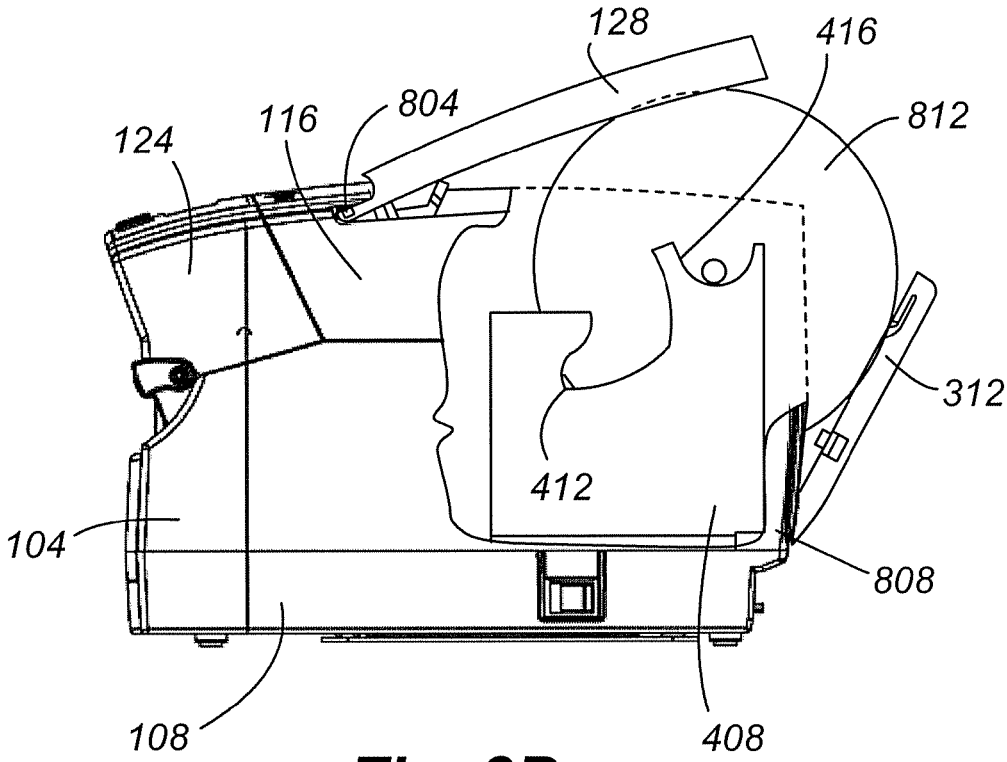
FIG. 8B is a partially cutaway view of the printing apparatus of FIG. 8A.
Figure 8A:
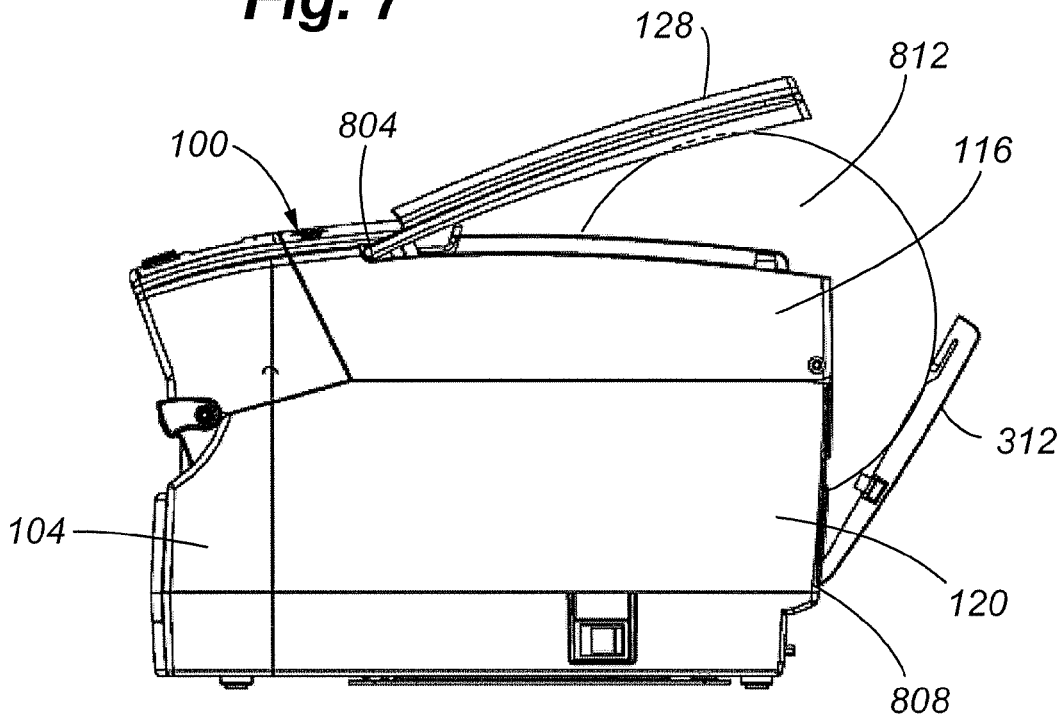
FIG. 8A is a right side view of a printing apparatus in accordance with embodiments of the present invention, with a top panel and rear panel positioned to accommodate a large print stock roll.

A printer 100 in accordance with embodiments of the present invention may additionally be capable of being placed in an open or expanded configuration for receiving a roll of print stock of a second size that is larger than the first size. For example, the second size may be a size that is typically associated with a mid-range or industrial printer, also known as "big box" printers. For example, this second size of print stock roll may have a maximum outer diameter of seven or even eight inches. A printer 100 in accordance with embodiments of the present invention with the enclosure 104 in an expanded configuration is illustrated in FIGS. 8A-B. In this expanded configuration, the top panel 128 is rotated about a top panel pivot axis 804 and the back panel 312 is rotated about a back panel pivot axis 808 to allow a print stock roll 812 of up to a second size to occupy a space that includes a volume that is greater than or outside of the volume of the printer enclosure 104 when the printer enclosure is in the closed configuration. As shown in FIG. 8B, when holding a print stock roll 812 of up to the second size, the second bay 416 of the print stock roll carrier 408 is used, and the first bay 412 is empty. Accordingly, a printer 100 having an enclosure 104 that has a size that is typically associated with one size of printer, such as a desktop printer, may accommodate print stock rolls 812 that are usually associated with a another, larger size of printer, such as a mid-range or industrial printer.

Figure 5:
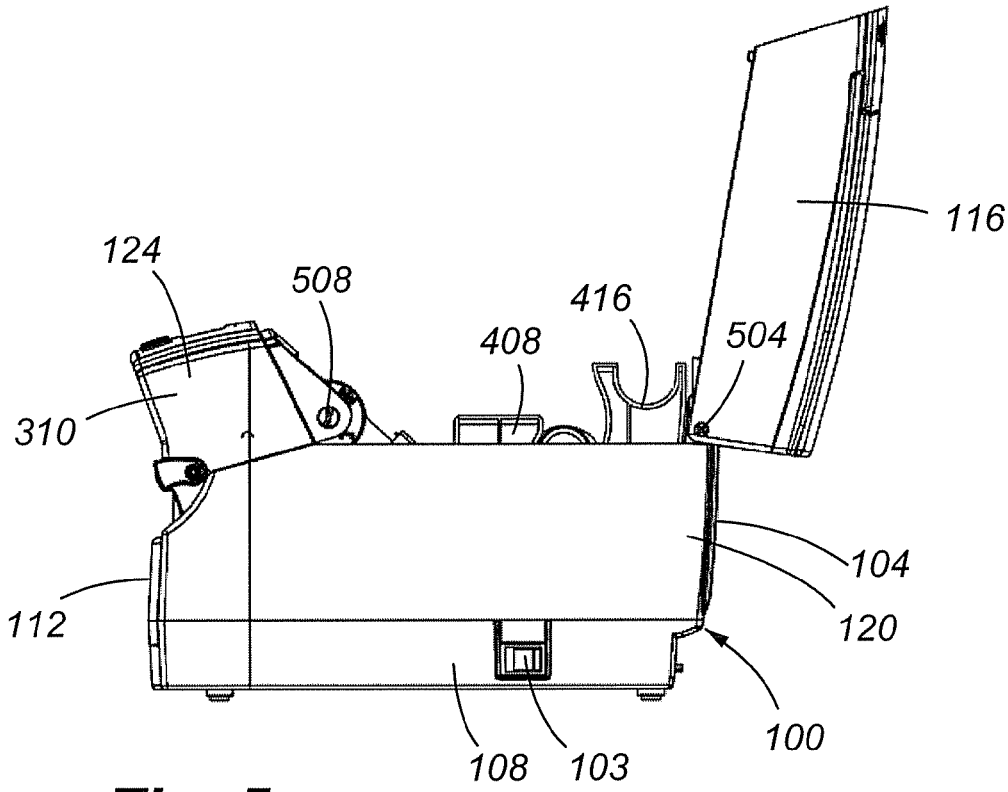
FIG. 5 is a right side view of a printing apparatus in accordance with embodiments of the present invention, with the top cover in an open position.

FIG. 5 illustrates a printer 100 in accordance with embodiments of the present invention with the cover 116 in an open position, showing the double clamshell design of the enclosure 104. As shown, the cover 116 may be placed in the open position by pivoting it about the cover axis 504. Opening the cover 116 provides a way for a user to access an interior of the enclosure 104, for example to load media by placing a print stock roll 404 or 812 in a bay 412 or 416 of the print stock roll carrier 408, or to remove an empty print stock roll core or spindle.

Figure 6:
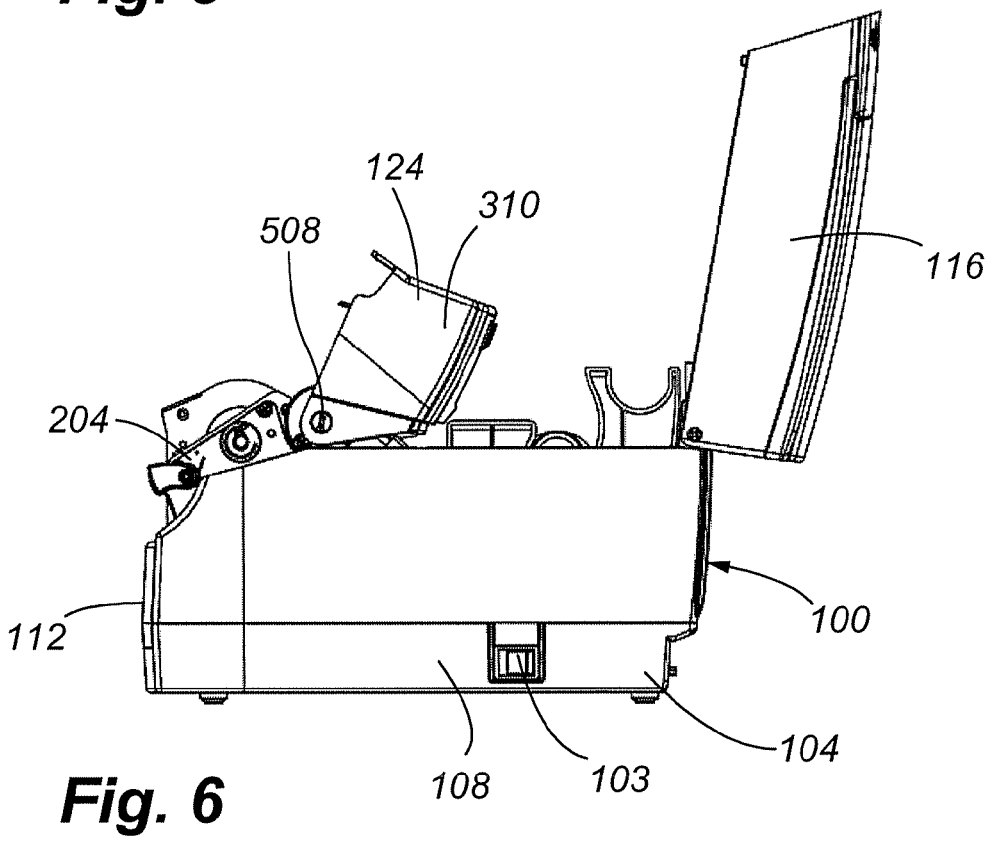
FIG. 6 is a right side view of a printing apparatus in accordance with embodiments of the present invention, with the user interface in a retracted position.
Figure 7:
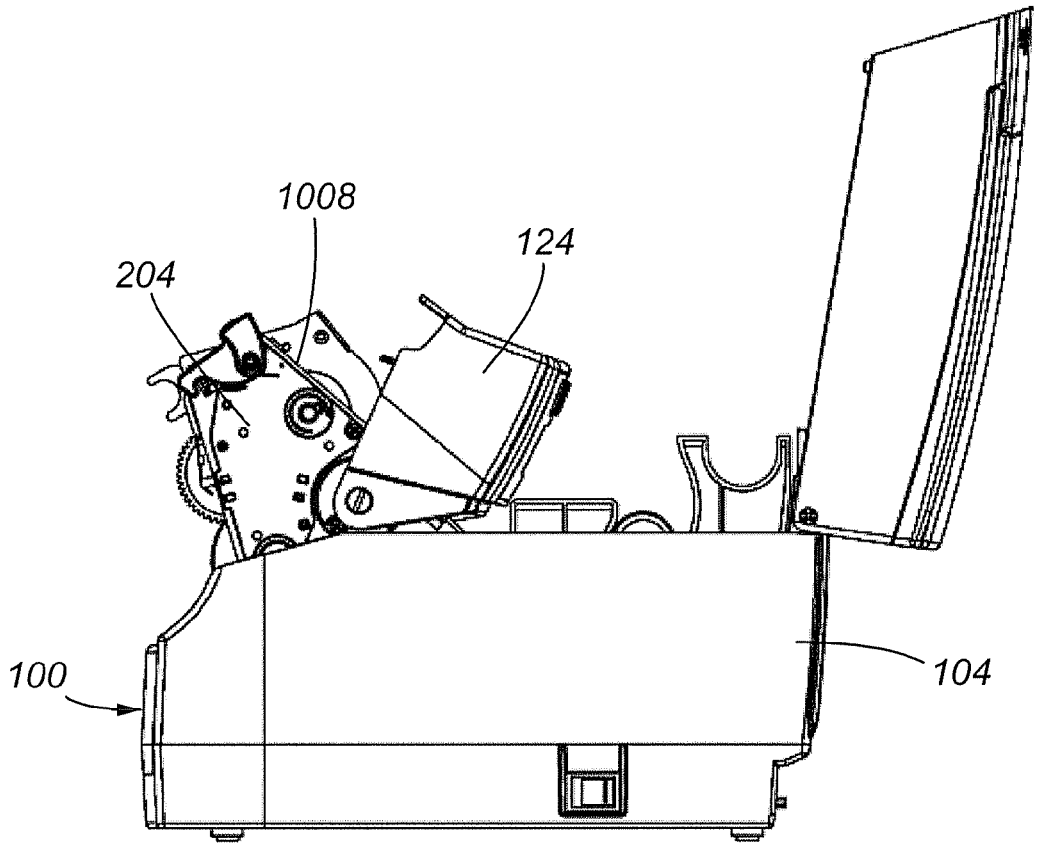
FIG. 7 is a right side view of a printing apparatus in accordance with embodiments of the present invention, with the print assembly in a disengaged state.

As also shown in FIG. 5, the user interface 124 is mounted to a pivot axis 508. By pivoting the user interface 124 into a raised position, as illustrated in FIG. 6, access to the printer assembly 204, for example for maintenance and/or for ribbon replacement, is facilitated. In accordance with embodiments of the present invention, a pivoting portion or sub-assembly 1008 of the printer assembly 204 is mounted to the same pivot axis 508 as the user interface 124. As shown in FIG. 7, at least a portion of the printer assembly 204 can thus be pivoted about the pivot axis 508, for example to facilitate access to an underside of the printer assembly 204 and to the interior of the enclosure 104. In addition, it can be appreciated that the user interface 124 receives and surrounds at least a portion, and in accordance with embodiments of the present invention at least about half the overall volume, of the printer assembly 204 when the user interface 124 and printer assembly 204 are both lowered. As a result, the overall compactness of the printer 100 is promoted. In addition, when the user interface 124 and the pivoting sub-assembly 1008 of the printer assembly 204 are both raised, the user interface 124 receives at least a portion of the printer assembly 204, improving user access to portions of the interior of the enclosure 104 as compared to alternatives in which the user interface 124 and printer assembly 204 occupy entirely separate volumes.

Figure 9:
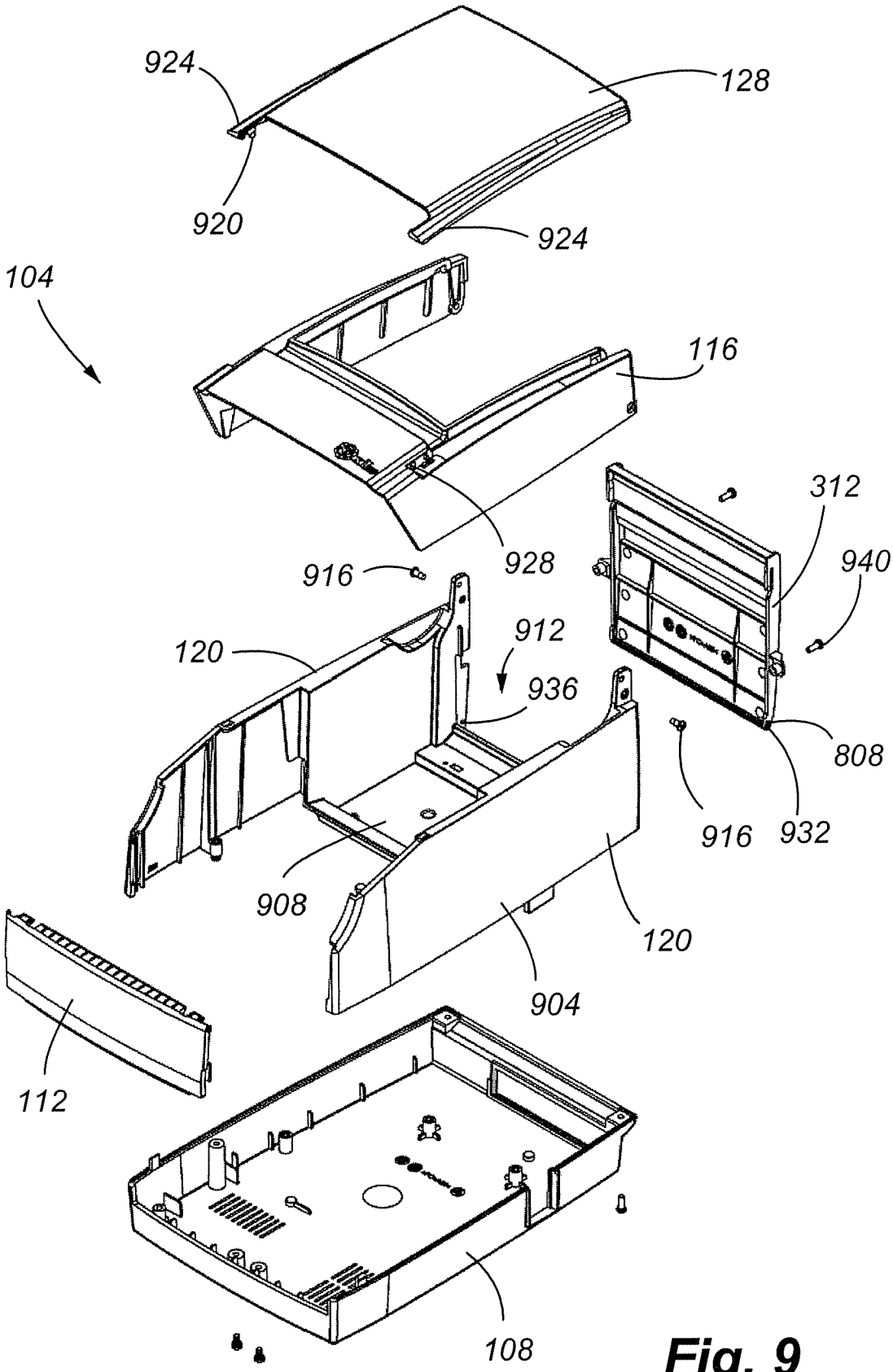
FIG. 9 is an exploded perspective view of a printing apparatus case in accordance with embodiments of the present invention.

An exploded perspective view of a printer case or enclosure 104 in accordance with embodiments of the present invention is shown in FIG. 9. In general, the components of the enclosure 104 include a base 108, which may be in the form of a tray. The sidewalls 120 may be part of a sidewall component 904. The sidewall component 904 may further include a connecting member 908. When the sidewall component 904 is joined to the base 108, a compartment that may be used to receive control and operational electronics and connectors is formed between the connecting member 908 and the base 108. The base member may also form the floor of a print stock compartment 912, with the sidewalls 120 forming the sides of the print stock compartment 912.

The cover 116 may be connected to the sidewall component 904 at the cover axis 504 by hinge pins 916. By pivoting the cover 116 about the cover axis 504, a user may access the interior of the enclosure. For example, a user may access the print stock compartment 912 for loading print stock.

The top panel 128 may be hinged to the sidewall component 904 about top panel pivot axis 804 by pins or studs 920 formed towards the end of and integral to longitudinal arms 924. The studs 920 in such embodiments are received in corresponding holes 928. As a result, the top panel 128 may be selectively placed in a closed position or configuration, for example as illustrated in FIG. 1, in which the top panel 128 edges or surfaces generally abut corresponding edges or surfaces of the cover 116, or in an open or expanded configuration, for example as illustrated in FIG. 8A.

The back panel 312 in the illustrated embodiment is joined to the sidewall component 904 when the enclosure 104 is in an assembled condition. The back panel can be hinged to the sidewall component about back panel pivot axis 808 by pins or studs 932 and corresponding holes 936. Accordingly, the back panel 312 can be selectively placed in a closed position or configuration, for example as illustrated in FIG. 1, in which the back panel 312 edges or surfaces generally abut corresponding edges or surfaces of the sidewall component 904, or in an open or expanded configuration, for example as illustrated in FIG. 8A. In addition, retaining pins 940 can be provided for securing the back panel 312 in the closed configuration if desired.

Figure 10:
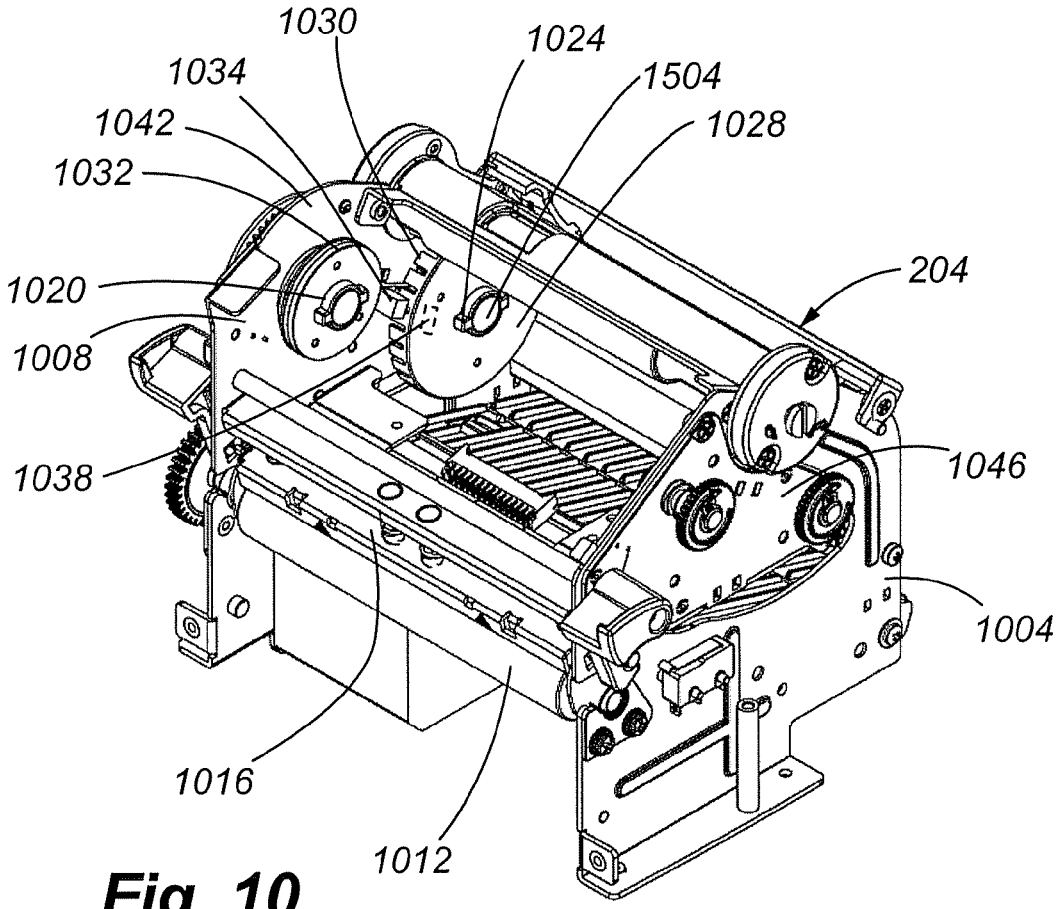
FIG. 10 is a perspective view of a printer assembly mechanism in accordance with embodiments of the present invention.

A printer assembly or printer assembly mechanism 204 in accordance with embodiments of the present invention is illustrated in FIG. 10. The printer assembly 204 generally includes a stationary sub-assembly 1004 and a pivoting sub-assembly 1008. In the illustrated embodiment, a platen 1012 is associated with the stationary sub-assembly 1004, while a print head sub-assembly 1016 is associated with the pivoting sub-assembly 1008. The print head sub-assembly 1016 is carried between pivoting side frame members 1042, 1046 comprising at least a portion of a printer assembly frame. By pivoting the pivoting sub-assembly 1008, the print head sub-assembly 1016 can be moved away from the platen 1012, for example to load print media or to service the print head or print head sub-assembly 1016. A print ribbon take-up sprocket 1020 and a print ribbon supply sprocket 1024 for carrying ribbon take-up and ribbon supply spools respectively are also shown. As can be appreciated by one of skill in the art, cooperating sprockets (not shown in FIG. 10) are provided for receiving an end of a spool or spindle held by a partner sprocket 1020 or 1024. In FIG. 10, no print ribbon is loaded in the printer assembly 204.

Accordingly, a configuration in which the print assembly 204 may be used for direct thermal printing is illustrated.

Figure 11:
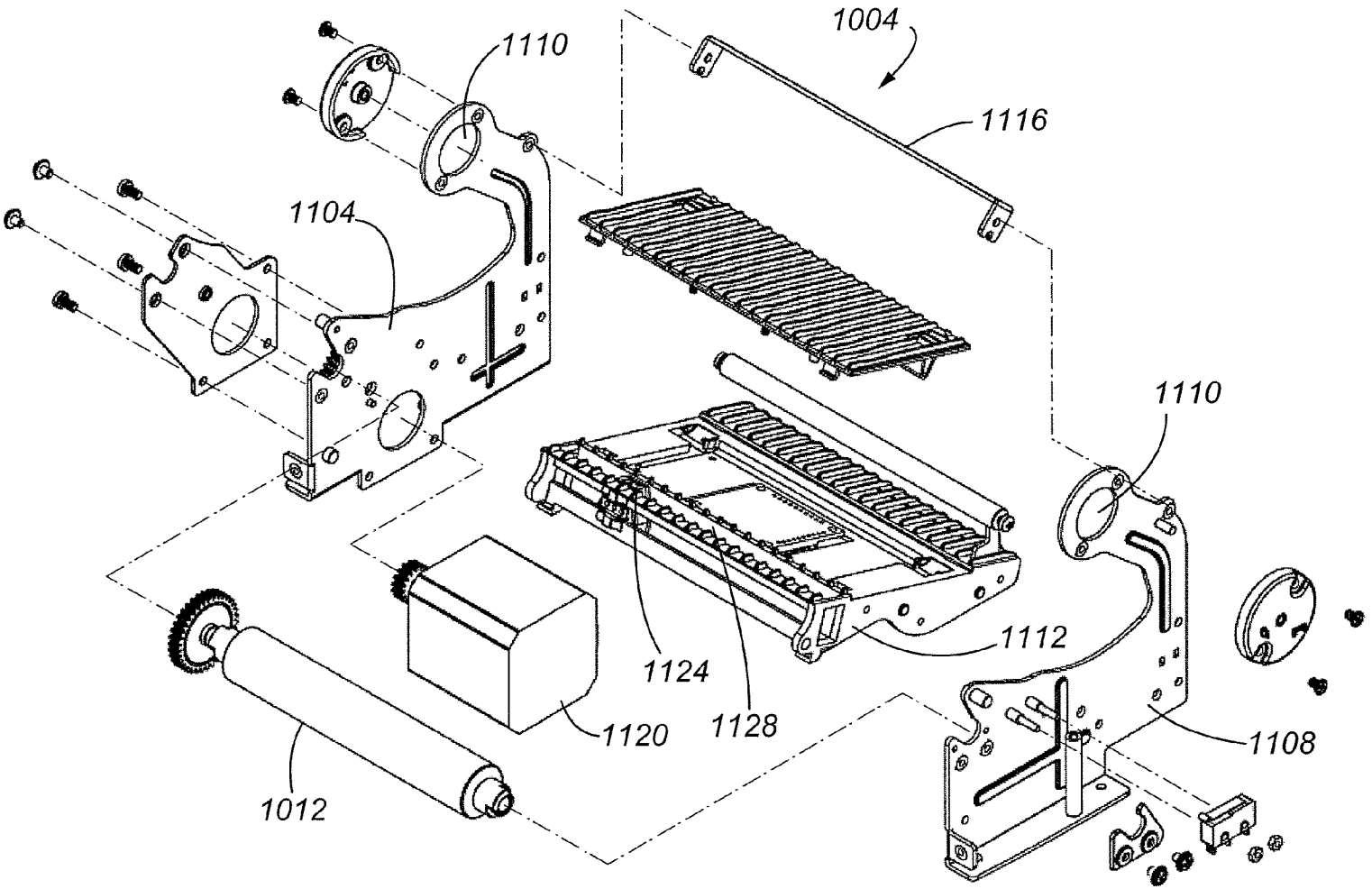
FIG. 11 is an exploded perspective view of a stationary sub-assembly of a printer assembly in accordance with embodiments of the present invention.

FIG. 11 is an exploded perspective view of the stationary sub-assembly 1004. The stationary sub-assembly 1004 includes stationary side frame members 1104 and 1108 interconnected to one another by a media support member 1112 and a cross-member 1116. The side frame members 1104 and 1108 include pivot points 1110, to which the pivoting sub-assembly 1108 is interconnected. Also shown is the drive motor 1120, which may comprise a stepper motor or other suitable motor, used to drive the platen 1012. The drive motor may also be used to drive a ribbon supply mechanism as described herein. Therefore, the drive motor 1120 may comprise at least a portion of a means for driving.

The media support member 1112 carries a means for receiving optical energy comprising a photo sensor or optical receiver 1124 in a channel 1128. The photo sensor 1124 is user adjustable across at least one-half the width of the media path. In accordance with other embodiments of the present invention, the location of the photo sensor 1124 may be adjusted across the entire width of the media path. As can be appreciated by one of skill in the art, the width of the media path is generally about equal to the width of the media support member 1112 and/or the width of the platen 1012. As described herein, the location of the photo sensor 1124 is user-adjustable in connection with media position and/or states sensing features of embodiments of the present invention.

Figure 12:
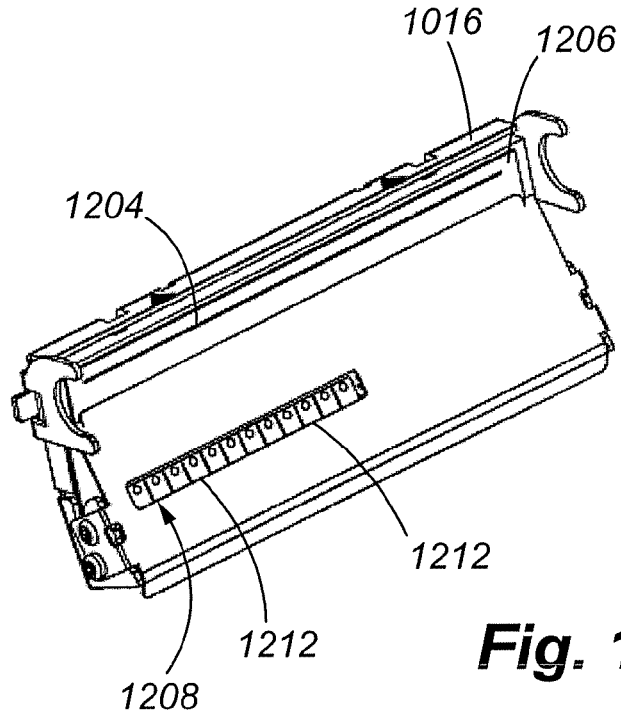
FIG. 12 is a bottom perspective view of a print head sub-assembly in accordance with embodiments of the present invention.

In FIG. 12, the print head sub-assembly 1016 is shown in a bottom side perspective view. In general, the print head sub-assembly 1016 includes a plurality of print elements or dots 1204. The print elements 1204 are depicted as a single line because a typical print head 1206 incorporated into a print head sub-assembly 1016 includes a relatively large number of closely spaced print elements 1204, in order to provide desired output resolutions. For example, a typical print head 1206 may provide resolutions of 203 dots per inch. A higher resolution print head 1206 may provide a resolution of 300 dots per inch. Accordingly, a print head 1206 having a maximum print width of 2 inches will typically include from about 400 to about 600 print elements 1204, while a print head 1206 having a maximum print width of 4 inches will typically include from about 800 to about 1200 print elements 1204.

The print head sub-assembly 1016 may also incorporate or be associated with a means for generating optical energy comprising a light source or a number of optical sources 1208 extending across at least a portion of the width of the print head sub-assembly 1016. More particularly, the optical sources 1208 may comprise light emitting diodes 1212 capable of providing focused light for purposes of media indexing. In accordance with embodiments of the present invention, the light source or optical sources 1208 extend across that portion of the media supply path width that comprises the effective media widths handled by the associated printer 100. For example, the optical sources 1208 may extend across one-half the width of the media path. As a further example, the optical sources 1208 may extend across the entire width of the media path. As described herein, light output by the optical sources 1208 is passed through media loaded in the printer and detected by the photo sensor 1124. As illustrated, an optical source 1208 may incorporate twelve light emitting diodes 1212, although a greater or lesser number of diodes 1212 or other types of optical sources 1208 may be incorporated.

Figure 13:
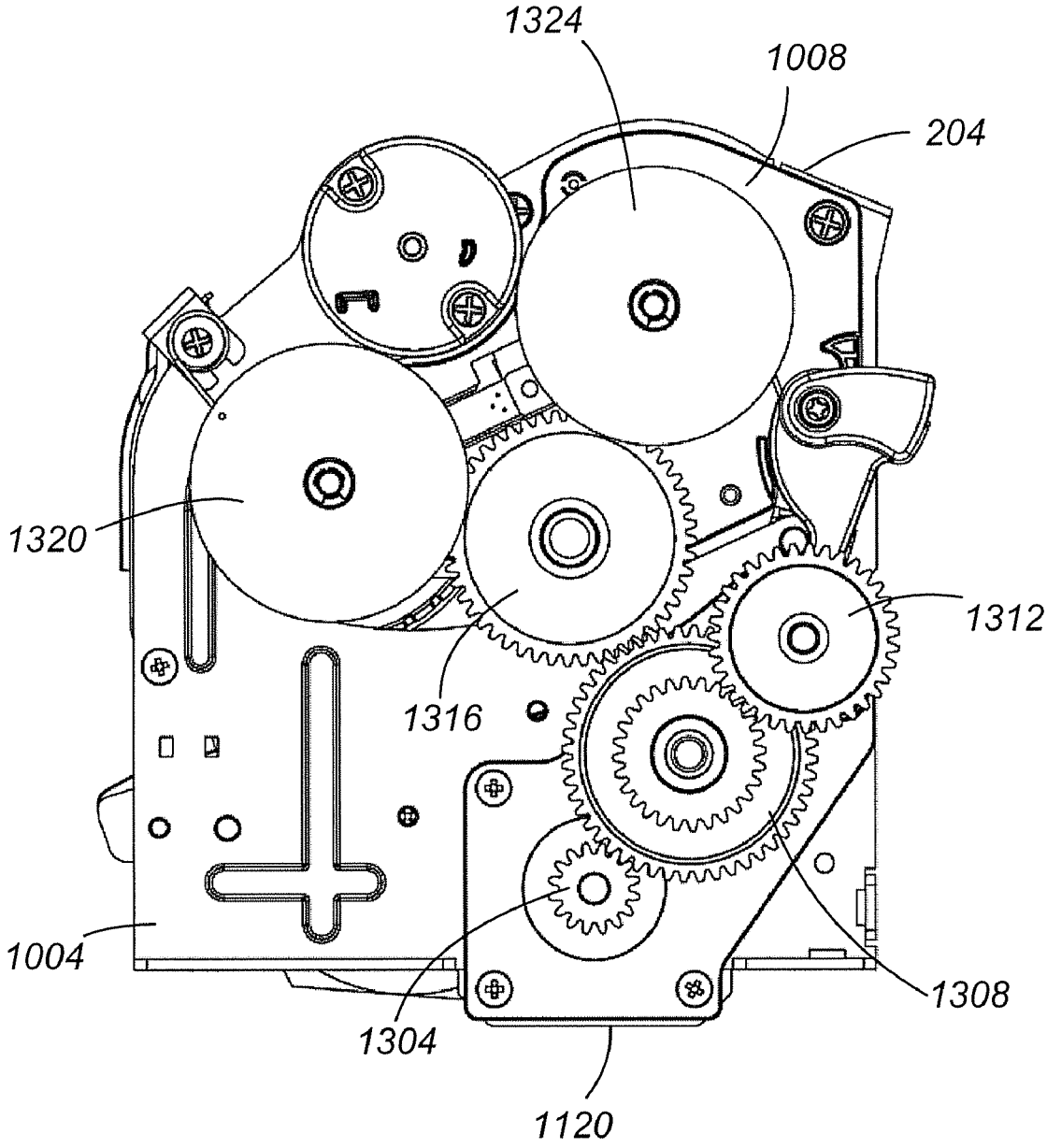
FIG. 13 is a side view in elevation of a printer assembly mechanism in accordance with embodiments of the present invention.

Various drive gears associated with the printer assembly 204 are shown in a side elevation of the printer assembly 204 in FIG. 13. In particular, the drive gear 1304 fixed to the shaft of the drive motor 1120 can be seen to act on a main power distribution gear 1308. The main power distribution gear 1308 in turn drives the platen 1012 through the platen gear 1312, and the print ribbon idler gear 1316. The print ribbon idler gear 1316 in turn drives the print ribbon supply gear 1320 and the print ribbon take-up gear 1324.

Figure 14:
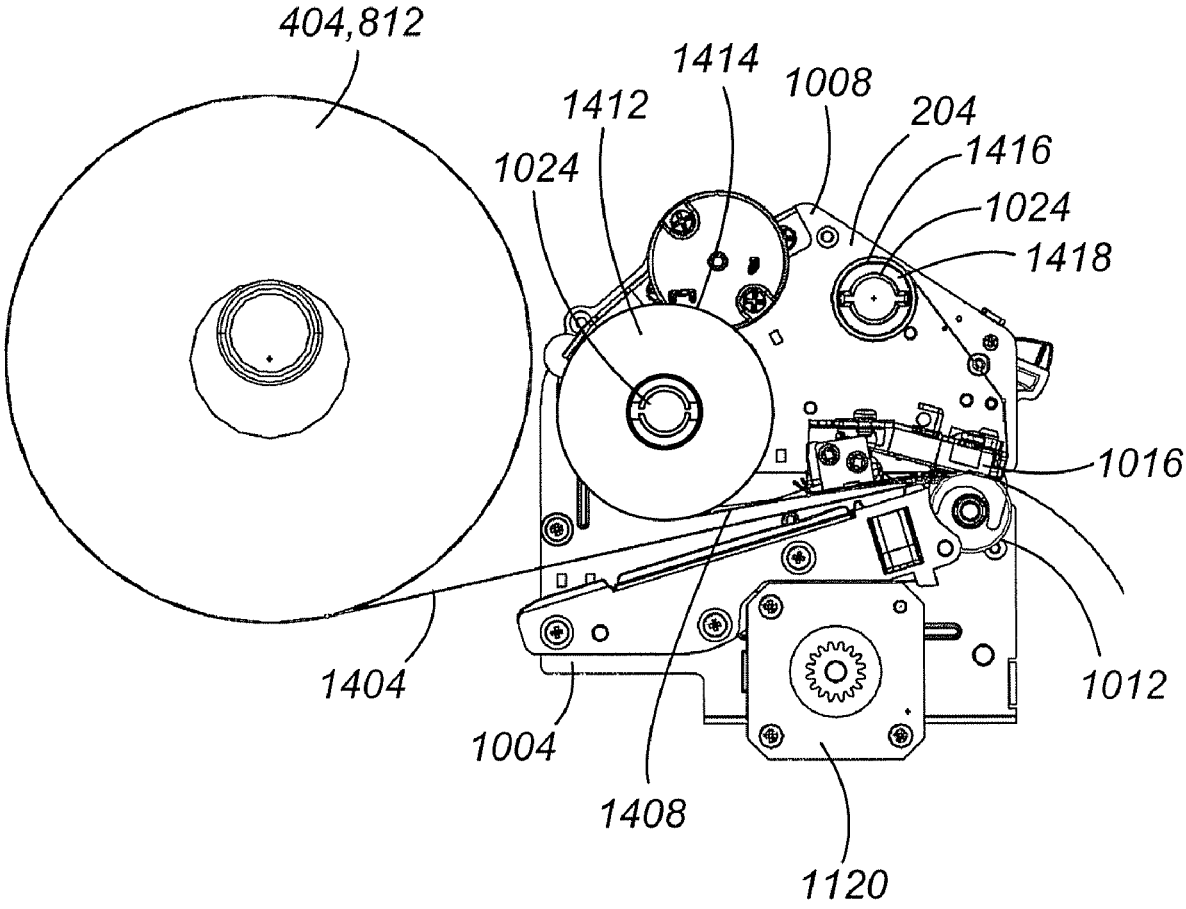
FIG. 14 is a cross-section of a printer assembly mechanism and print stock roll in accordance with embodiments of the present invention.

FIG. 14 is a cross-section of a printer assembly 204, showing the path of a print medium or print media 1404 through the printer assembly 204. In addition, a print ribbon 1408, extends from a print ribbon supply roll 1412 carried by a print ribbon supply roll carrier comprising a print ribbon supply roll spindle 1414 and/or a print ribbon supply sprocket 1024.

A print ribbon take-up roll 1416 is held by a print ribbon take-up carrier comprising a print ribbon take-up spindle 1418 and/or print ribbon take-up sprocket 1020. In general, it can be seen that the media is routed through the printer assembly 204 such that it passes over the platen 1012, and is pressed between the platen 1012 and the print head sub-assembly 1016, for example by springs or other biasing members. In addition, it can be seen that, when a print ribbon 1408 is in use, the print ribbon is held between the media 1404 and the print head sub-assembly 1016. The platen 1012 and the print head sub-assembly 1016 generally comprise a means for moving the print medium and the print ribbon past the print head. As can be appreciated by one of skill in the art, the print ribbon 1408 may comprise a wax, resin or combination of chemicals that can be transferred to a non-heat sensitive paper stock or media through the application of heat by the print elements 1214 associated with the print head sub-assembly 1016. Control of the print ribbon 1408 is important to the performance of the printer 100 when a print ribbon 1408 is used. In particular, tension should be maintained on the print ribbon 1408 as unused ribbon is drawn in the direction of printing (i.e. in the direction that the media 1404 travels through the printer assembly 204) from the print ribbon supply roll 1412 to the print ribbon take-up roll 1416. Tension should also be maintained when the media is moved in reverse, in the direction opposite of printing, for example to position the media for proper print registration, which typically requires that the print ribbon 1408 be moved in the same direction as the media 1404.

Figure 15:
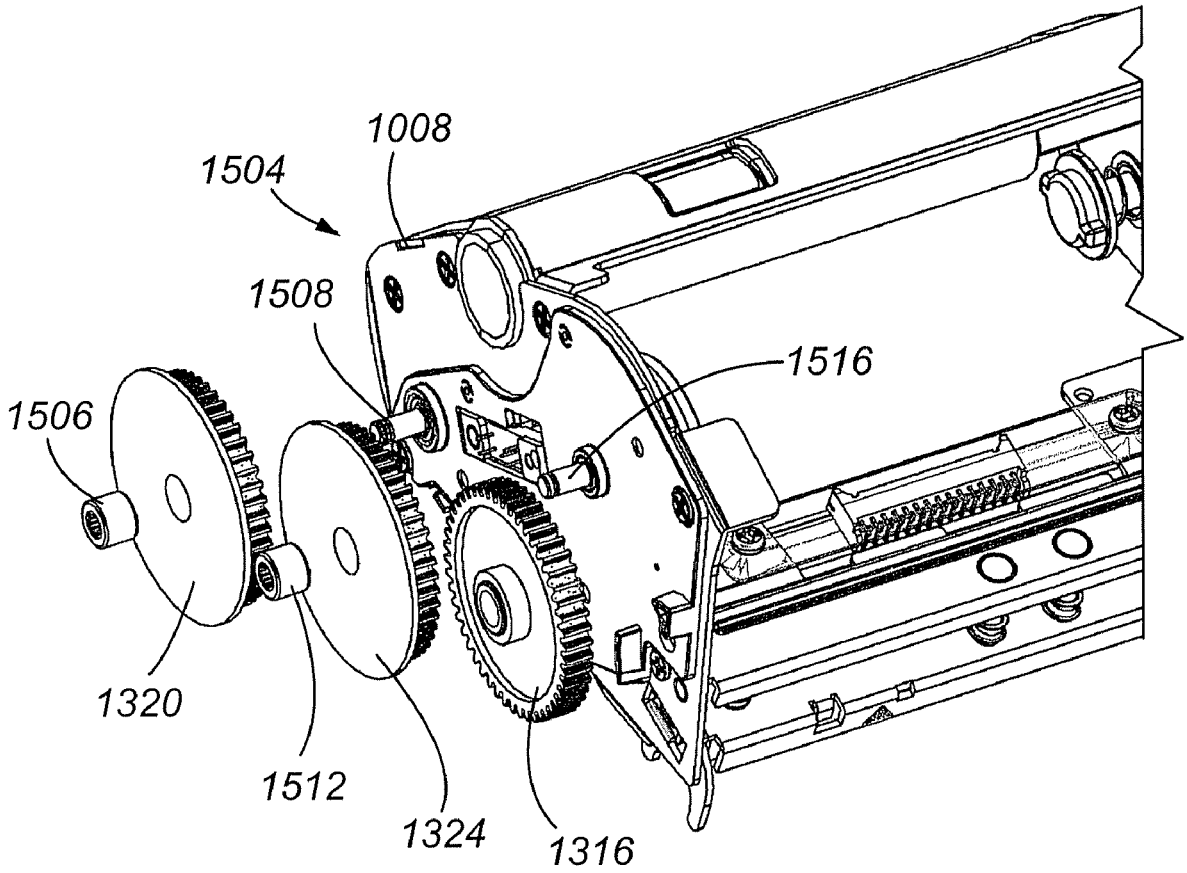
FIG. 15 is an exploded perspective view of components of a printer assembly mechanism in accordance with embodiments of the present invention.

In accordance with embodiments of the present invention, a print ribbon supply mechanism 1504 that maintains ribbon tension regardless of the direction or amount of print ribbon movement is provided. With reference now to FIG. 15, aspects of such a print ribbon supply mechanism 1504 are illustrated in a partially exploded perspective view of components of the pivoting sub-assembly 1008 of a printer assembly 204. In particular, the print ribbon idler gear 1316 drives the print ribbon supply gear 1320 and the print ribbon take-up gear 1324 in the same direction. A one-way bearing 1506 interconnects the print ribbon supply gear 1320 to the print ribbon supply shaft 1508. Another one-way bearing 1512 interconnects the print ribbon take-up gear 1324 to the print ribbon take-up shaft 1516. As used herein, a one-way bearing is a directional coupling or means for transferring torque in one direction only. In operation, the driving member can transmit torque through the one-way bearing to rotate the driven member when the driving member rotates in a first direction. However, the one-way bearing automatically disengages the driving member from the driven member when the driving member is rotated in a second direction. In accordance with embodiments of the present invention, a one-way bearing may comprise a freewheel incorporating locking rollers, sprags, ramps and roller bearings, ratchets or any other mechanical arrangement for effecting such a directional coupling.

With reference again to FIG. 10, the print ribbon supply shaft is fixed to the driving side of a print ribbon supply clutch 1028. The driven side of the print ribbon supply clutch 1028 may incorporate the print ribbon supply sprocket 1024. The driven side of the print ribbon supply clutch 1028 may also incorporate an optical interrupter or encoder 1030 arrangement. As illustrated, the optical interrupter 1030 may comprise a plurality of teeth around the outer diameter or rim of the print ribbon supply clutch, with a gap separating each tooth from its neighboring teeth. A print ribbon supply light source 1034 may be mounted adjacent the optical interrupter 1030 such that light from the source 1034 is incident on the optical interrupter 1030. Accordingly, as the print ribbon supply sprocket 1024 rotates, the light received by a print ribbon supply optical sensor 1038 located on the other side of the optical interrupter 1030 from the light source 1034 will be pulsed or intermittent. As can be appreciated by one of skill in the art, the light source 1034 and the optical sensor 1038 may be part of an integral unit that allows the optical interrupter 1030 to pass between the light source 1034 and sensor 1038 portions of the unit. As described elsewhere herein, a signal produced by the sensor 1038 in response to the received light can be used to determine the revolutions per minute (rpm) at which the print ribbon supply reel is rotating, and therefore the amount of print ribbon available on the supply reel. The print ribbon take-up shaft 1516 is fixed to the driving side of a print ribbon take-up clutch 1032. The driven side of the print ribbon take-up clutch 1032 may incorporate the print ribbon take-up sprocket 1020. As can be appreciated by one of skill in the art after consideration of the present disclosure, the clutches 1028 and 1032 may comprise friction clutches. For example, the clutches 1028 and 1032 may include a felt friction plate for transferring torque between the driving and the driven sides of the clutch, while allowing the two sides to rotate at different rates.

Figure 16A:
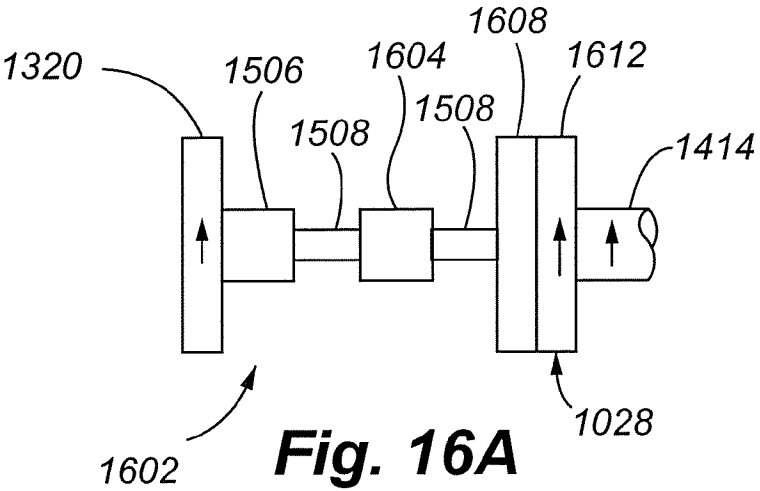
FIG. 16A is a schematic depiction of the supply side of a mechanism for maintaining tension in a print ribbon in accordance with embodiments of the present invention in a supply mode.

Additional features of the print ribbon supply mechanism 1504 are depicted schematically in FIGS. 16A, 16B, 17A and 17B. In particular, the relationships and operational modes of components of the ribbon supply mechanism are depicted. Components included in the supply side or means for supplying a print ribbon during forward operation of a printer 1602 of the print ribbon supply mechanism 1504 are depicted in FIG. 16A, with arrows indicating the direction of rotation of components that are moving while the print mechanism 1504 is being operated in a forward direction (i.e. in the direction that print media 1404 is supplied from the print stock roll 404 or 812). As can be appreciated by one of skill in the art, during normal printing, the print ribbon 1408 is drawn from the print ribbon supply roll 1412 by the movement of the print media 1404 through the printer assembly 204. The movement of the print media 1404 is itself caused by the print head sub-assembly 1016 pressing the print media 1404 against the platen 1012 through the print ribbon 1408.

In the forward direction the print ribbon supply gear 1320 is driven in a first direction, as depicted by the arrow associated with the print ribbon supply gear 1320. However, the print ribbon supply spindle 1414 is not driven by the print ribbon supply gear 1320 in the forward direction. Instead, the supply gear one-way bearing 1506 connecting the ribbon supply gear 1320 to the print ribbon supply shaft 1508 is in an idle mode when the print ribbon supply gear 1320 is driven in the first direction, such that driving torque is not transferred from the print ribbon supply gear 1320 to the print ribbon supply shaft 1508. In order to provide tension in the print ribbon between the supply roll 1412 and print interface between the media 1404 and the print head sub-assembly 1016, another one-way bearing, the tensioning one-way bearing 1604, acts on the print ribbon supply shaft 1508 to brake or stop the supply shaft from rotating. Accordingly, the tensioning one-way bearing or means for braking rotation of the means for supplying a print ribbon during forward operation of the printer 1604 interconnects the supply shaft 1508 to the frame of the printer assembly 204 or some other fixed member. The supply shaft 1508 is also connected to the driving plate 1608 of the print ribbon supply clutch 1028. Because the supply shaft 1508 is prevented from rotating in the forward direction, the driving plate 1608 is also prevented from moving in the forward direction. Therefore, as the print ribbon is drawn from the print supply roll 1412, causing the print ribbon supply spindle 1414 and in turn the driven plate 1612 of the print ribbon supply clutch or means for permitting the means for supplying a print ribbon to rotate at different rates than the means for driving 1028 to be rotated, tension is imparted to the print ribbon 1408 due to resistance to such rotation as a result of friction between the rotating driven clutch plate 1612 and the stationary driving clutch plate 1608. The tension in the print ribbon 1408 allows the position of the print ribbon to be better controlled during forward printing operations as compared to arrangements in which the print ribbon is freely drawn from the supply roll 1412.

Figure 16B:
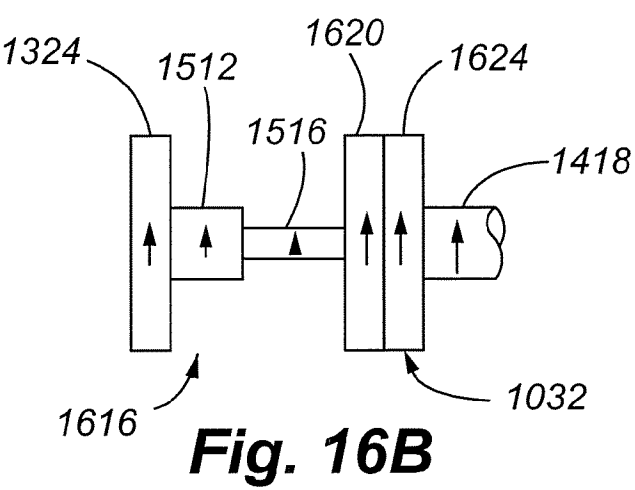
FIG. 16B is a schematic depiction of the take-up side of a mechanism for maintaining tension in a print ribbon in accordance with embodiments of the present invention in a supply mode.

The print ribbon take-up side or means for taking-up the print ribbon during forward operation of a printer 1616 of the print ribbon supply mechanism 1504, when operated in the forward direction, takes up the ribbon 1408 as it is drawn past the print head sub-assembly 1016 by the platen 1012. As depicted in FIG. 16B, in the forward direction torque from the take-up roll drive gear 1324 is transmitted to the take-up shaft via a take-up side one-way bearing 1512. In order to maintain tension in the print ribbon 1408 between the platen 1012 and the take-up roll 1416, the take-up drive gear 1324 is driven in the forward direction such that the rate at which the print ribbon 1408 would be wound on the take-up roll 1416 is greater than the rate at which the print ribbon 1408 is passed through the print interface by the platen 1012 for any possible print ribbon take-up roll 1416 diameter. In order to accommodate the different rates, the take-up clutch or means for permitting the means for taking-up the print ribbon to rotate at different rates than the means for driving 1032 allows the driving plate 1620 to rotate more quickly than the driven plate 1624. The friction between the take-up clutch 1032 plates 1620, 1624 thus provides tension in the print ribbon 1408.

In the direction of media 1404 back-up, the print ribbon supply gear 1320 is driven in a second or reverse direction. In this second direction, the one-way bearing 1506 transmits torque from the print ribbon supply gear 1320 to the print ribbon supply shaft 1508 (see FIG. 17A). Accordingly, the print ribbon supply shaft 1508 rotates with the print ribbon supply gear 1320. Moreover, this rotation of the print ribbon supply shaft is not opposed by the tensioning one-way bearing 1604. The rotation of the print ribbon supply shaft 1508 is transferred to the print ribbon supply spindle 1414 by the print ribbon supply clutch 1028. Accordingly, the components of the supply side 1602 of the print ribbon supply mechanism 1504 are all driven in the second direction. Because the print ribbon supply gear 1320 is driven at a rate that, for any ribbon supply roll 1412 diameter, is greater than the rate at which the print media 1404 is moved in the reverse direction, the driving plate 1608 of the print ribbon supply clutch 1028 rotates at a higher rate than the driven plate 1612. The excessive rpm of the supply shaft 1508 relative to the supply roll 1412 therefore operates to create a tension in the print ribbon 1408, at least between the platen 1012 and the print ribbon supply roll 1412.

Figure 17A:
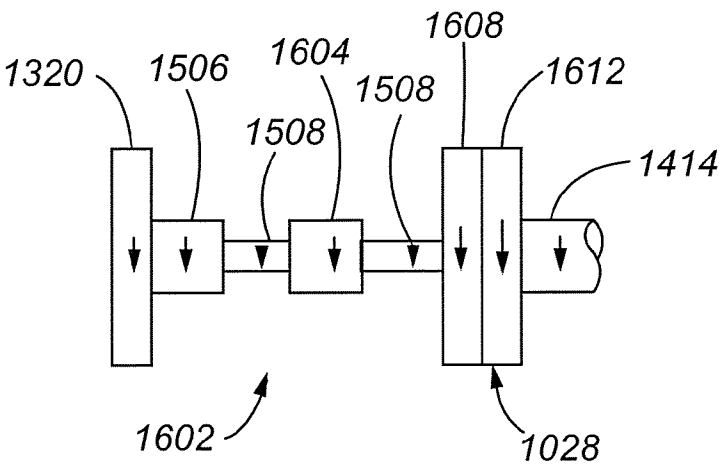
FIG. 17A is a schematic depiction of the supply side of a mechanism for maintaining tension in a print ribbon in accordance with embodiments of the present invention in a reverse mode.
Figure 17B:
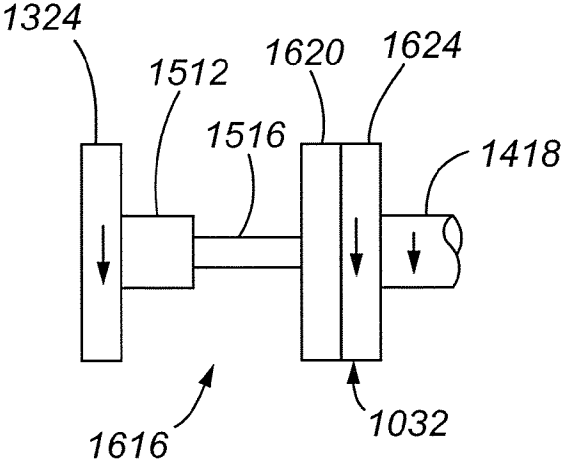
FIG. 17B is a schematic depiction of the take-up side of a mechanism for maintaining tension in a print ribbon in accordance with embodiments of the present invention in a reverse mode.

In the reverse direction, the print ribbon take-up gear 1324 of the take-up side 1616 of the print ribbon supply mechanism 1504 is prevented from transferring torque to the print ribbon take-up shaft 1516 by the take-up side one-way bearing 1512 (see FIG. 17B). Accordingly, the take-up spindle 1418 is free to rotate to provide print ribbon 1408 as drawn from the take-up roll by the platen 1012 and/or the supply side 1602 of the print ribbon supply mechanism 1504. Although not illustrated in the embodiment illustrated in FIGS. 16B and 17B, it should be appreciated that the print ribbon take-up shaft may be associated with a one-way bearing to prevent movement of the take-up shaft in the reverse direction, to help ensure that the section of print ribbon between the take-up roll 1416 and the platen 1012 is adequately tensioned.

Figure 18:
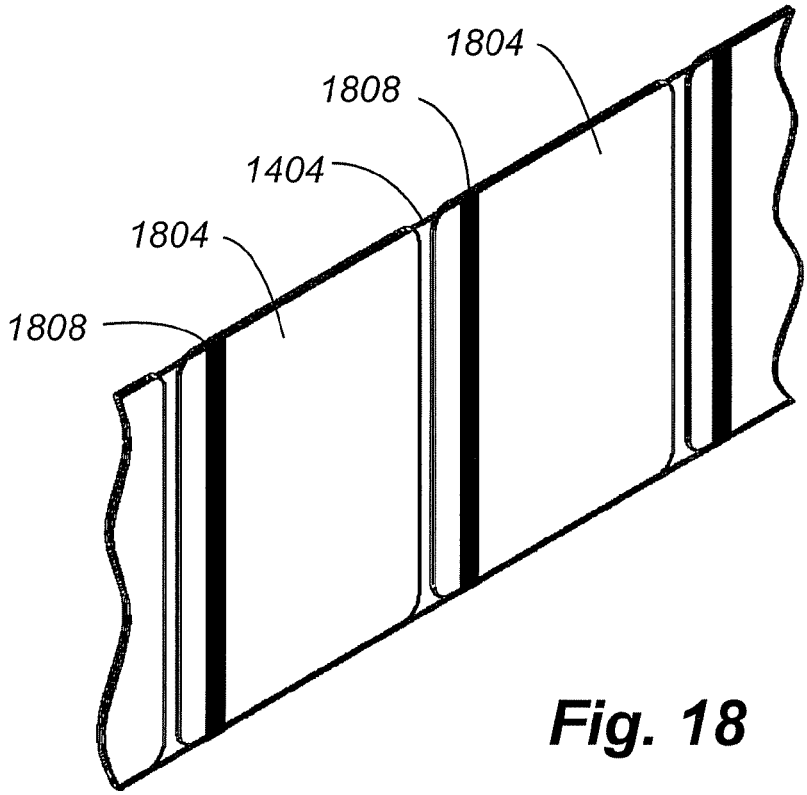
FIG. 18 is a perspective view of a portion of a strip of printer stock in accordance with embodiments of the present invention.

FIG. 18 illustrates a section of print media 1404 in accordance with embodiments of the present invention. In particular, a section of print media 1404 comprising adhesive-backed labels 1804 is illustrated. Each label includes an index or indexing mark 1808. As can be appreciated by one of skill in the art, the indexing mark can be used to determine the position of a label 1804 relative to the print head 1206, to ensure that printed content is placed correctly on the label 1804. Moreover, it can be appreciated by one of skill in the art that the indexing of print media features other than labels 1804 can also be important to providing desired output. For example, a print medium may contain preprinted material, perforations, labels, or other features, alone or in various combinations, that need to be properly indexed to ensure that printed content is created in the proper location on the print media 1404.

Figure 19:
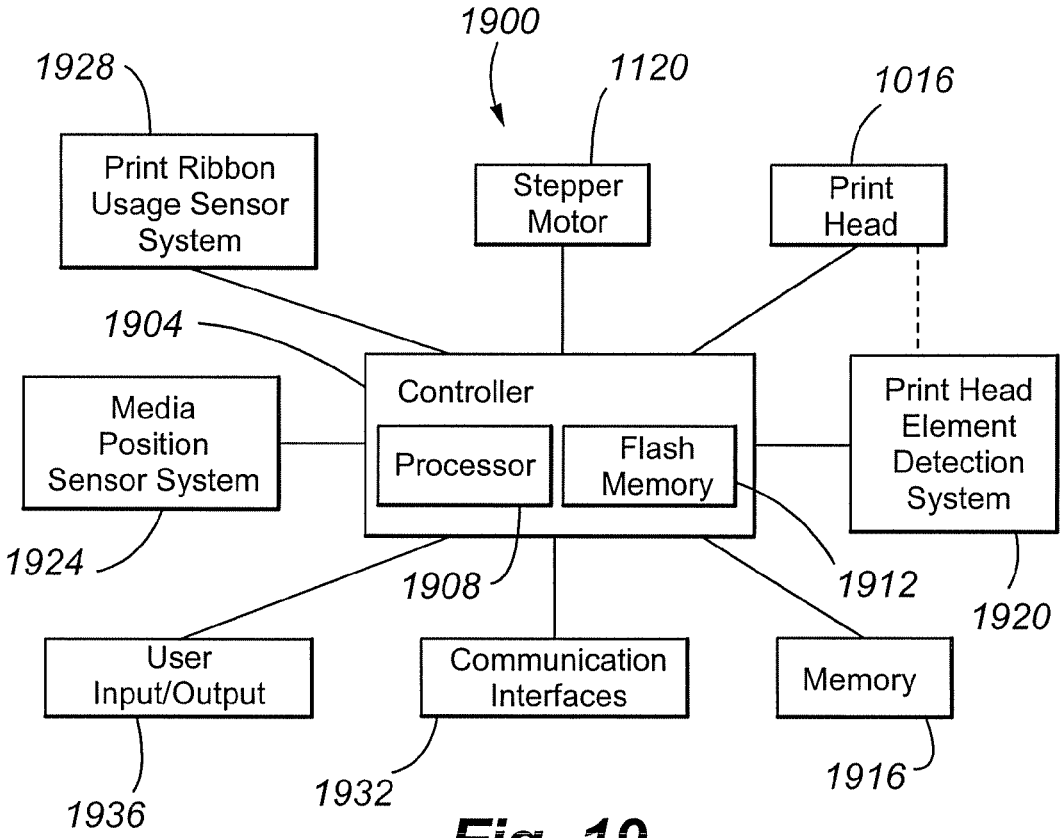
FIG. 19 is a block diagram depicting components of a printer electronic control assembly in accordance with embodiments of the present invention.

FIG. 19 is a block diagram depicting functional components of a printer electronic control assembly 1900 in accordance with embodiments of the present invention. In general, the control assembly 1900 includes a controller 1904 comprising a processor 1908 and flash memory 1912. The controller 1904 may be also be associated with additional memory 1916. Application instructions and/or programming may be stored in the memory 1912 and/or 1916 for execution by the processor 1908 in connection with implementing various operations and features of the printer 100. In addition, the memory 1912 and/or 1916 may be used to store data related to printed content.

One of the functions of the controller 1904 is to control operation of the print head 1206. In addition, the controller 1904 and the print head 1206 can be associated with a print head element condition detection system 1920. The controller 1904 may also operate the drive motor 1120 to position and feed print media 1404 and or a print ribbon 1408. Another function that can be performed in association with the controller 1904 relates to sensing and controlling the position of print media 1404, for example in association with a media position sensor system 1924. The controller 1904 can also receive input from a print ribbon usage sensor system 1928 to determine an amount of print ribbon 1408 left on the print ribbon supply roll 1412.

The control assembly 1900 is generally associated with one or more communications interfaces 1932. Examples of communication interfaces 1932 include USB 2.0, USB A, IEEE-1284, RS-232, Ethernet or other wireline communication interfaces. Other examples of communication interfaces 1932 include the various IEEE 802.11 protocols, Bluetooth, or other wireless interfaces. The provided communications interfaces 1932 place the controller 1904 in communication with other devices or computers. User input/output facilities 1936, such as input buttons 132 provided as part of the user interface assembly 124 for receiving user input may deliver input signals to the controller 1904. In addition, output in the form of textual information, indicator lamps and audible alarms may be provided by the controller 1904 through the user input/output facilities 1936.

Figure 20:
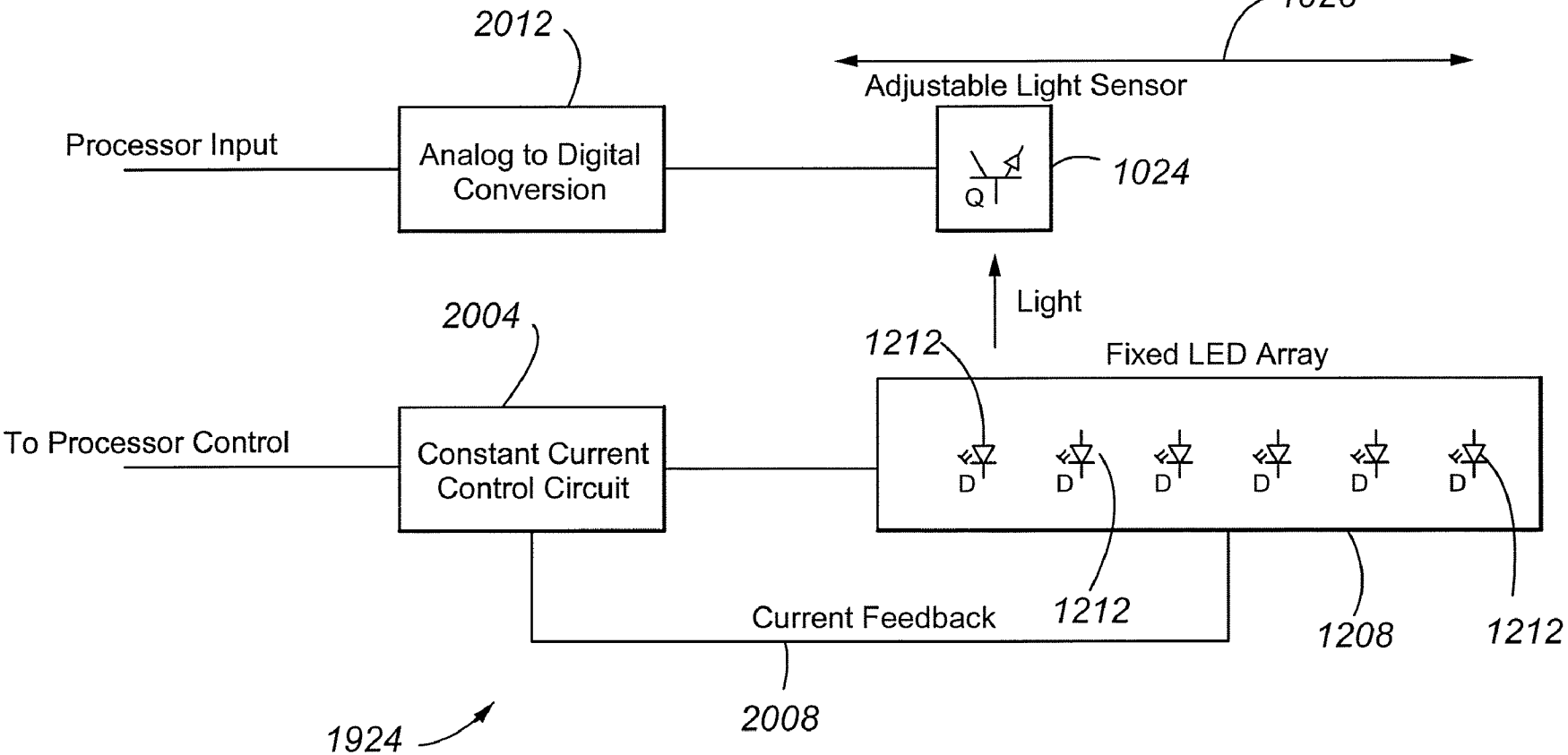
FIG. 20 is a schematic depiction of components of an LED sensor array in accordance with embodiments of the present invention.

Components that may be included in a media position sensor system 1924 in accordance with embodiments of the present invention are illustrated in FIG. 20. In particular, a constant current control circuit 2004 may, in response to an activation signal from the controller 1904, provide an activation signal to optical sources 1208, such as light emitting diodes 1212 that each provide a focused output. In accordance with embodiments of the present invention, the optical sources 1208 are arrayed across at least a portion of the print head sub-assembly 1016 such that at least one of the optical sources 1208 is in a position to intersect an indexing mark

1808 provided as part of supported print media 1404. A current feedback signal line 2008 may be used by the constant current control circuit to ensure that a constant current is supplied to the optical sources 1208, so that the intensity of light output by the optical sources 1208 is constant.

A photo sensor 1024 is positioned so that it is on an opposite side of the media path from the optical sources 1208. The position of the photo sensor 1024 across the width of the media path may be user adjustable. For example, a user will generally position the photo sensor 1024 so that indexing marks 1808 on media 1404 loaded in the printer will pass over the photo sensor 1024. In accordance with embodiments of the present invention, any available position of the photo sensor 1024, depicted by line 1026, will be adjacent an optical source 1208. The analog output from the photo sensor 1024 may be converted to a digital signal by an analog to digital converter 2012, before the signal is passed to the controller 1904 for analysis.

Figure 21:
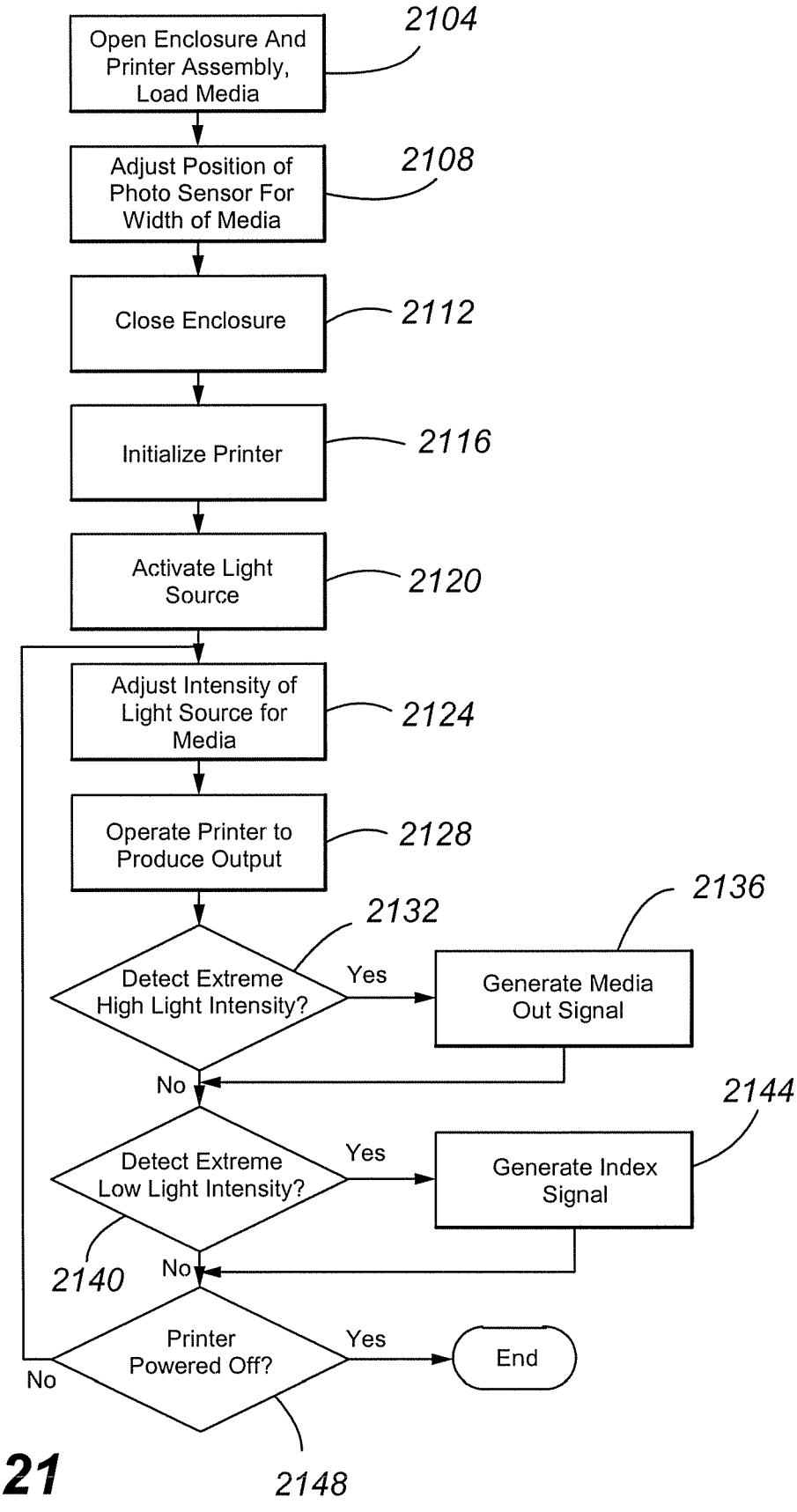
FIG. 21 is a flowchart depicting aspects of the operation of an LED sensor array in accordance with embodiments of the present invention.

Aspects of the sensing of media position in connection with a media position sensor system 1924 operated under the control of or in association with the controller 1904 are illustrated in FIG. 21. Initially, a user opens the printer 100 enclosure 104 and the printer assembly 204 as necessary, and loads a print stock roll 404 or 812 in the printer 100 (step 2104). The user then adjusts the position of the photo sensor 1024 for the width of the loaded print media 1404 (step 2108). More particularly, the position of the photo sensor 1024 is adjusted so that it will be adjacent any indexing marks 1808 provided by the media 1404. The enclosure 104 and printer assembly 204 may then be closed (step 2112), and the printer initialized (step 2116).

As part of or following the initialization of the printer, the light source or optical sources 1208 are activated (step 2120). The intensity of the optical sources 1208 is adjusted or calibrated as appropriate for the media 1404 (2124). This may comprise generating light at a selected intensity, and determining the intensity of the light as received by the photo sensor 1024. Adjustments can then be made as appropriate for the media 1404. For example, media 1404 comprising relatively translucent stock will require the optical sources 1208 to generate light at less intensity than relatively opaque media. The intensity should generally be adjusted to some intermediate value while the light from the optical sources is passing through an area of print media 1404 that does not correspond to an indexing mark 1808. The media 1404 can be moved for at least some distance while adjusting the intensity of the light source 1208, to ensure that the adjustment is not made while the light source 1208 is adjacent an indexing mark or some other discontinuity, such as a gap between labels in media 1404 comprising label stock.

After calibrating the output of the light sources 1208 for the loaded media 1404, the printer 100 can be operated to produce printed output (step 2128). While operating the printer 100 to produce printed output, the intensity of light received at the photo sensor 1024 can be monitored. For example, a determination can be made as to whether an extreme high in light intensity is detected (step 2132). If an extreme high in light intensity is detected, it can be taken as an indication that there is no media 1404 interposed between the optical sources 1208 and the photo sensor 1024, and a "media out" signal can be generated (step 2136). As can be appreciated by one of skill in the art, the media out signal can comprise various user perceptible signals, such as a visual and/or audible alarm.

A determination may also be made as to whether an extreme low in light intensity is detected (step 2140). Although this determination is illustrated in the figures as being made after a determination related to whether an extreme high in light intensity is detected, this is not necessarily the case. For example, the determination as to whether an extreme low in light intensity is detected can be made before or concurrently with a step to determine whether an extreme high in light intensity is detected. If an extreme low in light intensity is detected, an index signal may be generated (step 2144). As can be appreciated by one of skill in the art, the index signal can be used by the controller 1904 to determine the position of the media, and in particular features of the media 1404, relative to the print head 1206.

A determination may then be made as to whether the printer 100 has been powered off. If the printer 100 has not been powered off, operations continue, and the process can return to step 2124. If the printer 100 has been powered off, the process for sensing media 1404 position may end.

Figure 22:
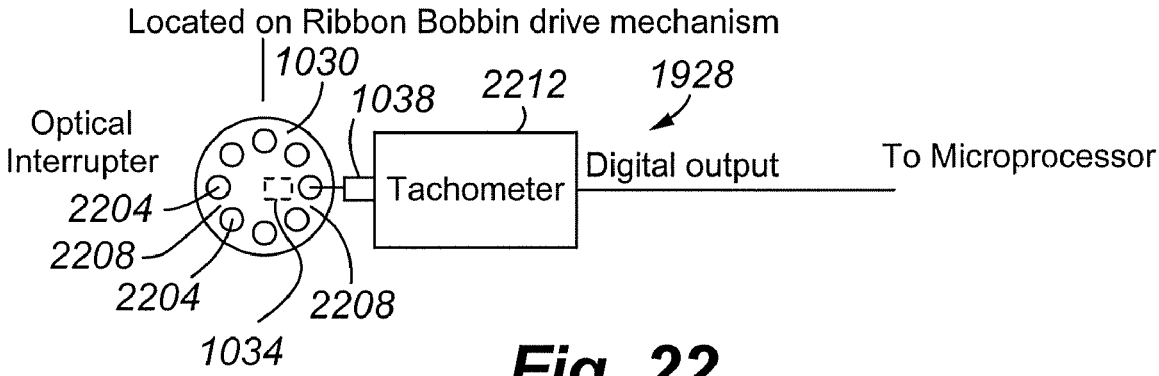
FIG. 22 is a schematic depiction of components of a circuit for determining print ribbon usage in accordance with embodiments of the present invention.

Features of a print ribbon usage sensor system 1928 in accordance with embodiments of the present invention are illustrated in FIG. 22. The system generally includes the optical interrupter 1030, which generally rotates at a rate determined by the rate of rotation or rpm of the print ribbon supply reel 1412. For example, the optical interrupter 1030 may be integral to the driven side 1612 of the print ribbon supply clutch 1028. As the optical interrupter 1030 rotates, light from the light source 1034 is alternately transmitted by holes or gaps 2204 and blocked by teeth or opaque portions 2208. As a result, light from the light source 1034 is intermittently allowed to reach the sensor 1038. The frequency at which the pulses of light reach the sensor 1038 is determined by a tachometer 2212 and provided as a digital signal to the controller 1904. The frequency of the light pulses is a function of the rpm of the optical interrupter 1030. Accordingly, when the print ribbon supply roll 1412 is almost full, the rpm of the print ribbon supply roll 1412 for a given rate at which the media 1404 and therefore the print ribbon 1408 are traveling is relatively low. When the print ribbon supply roll 1412 is relatively empty, the rpm of the roll 1412 will be higher than when the roll 1412 is relatively full. In particular, because the velocity of the print ribbon past the print head 120 is controlled by the media 1404 and in turn the platen 1012 and is therefore known, the amount of print ribbon 1408 remaining on the supply roll 1412 can be determined from the rpm of the print ribbon supply roll 1412. Moreover, the amount of print ribbon remaining can be determined with a high degree of precision for any amount of print ribbon remaining on the supply roll 1412.

Figure 23:
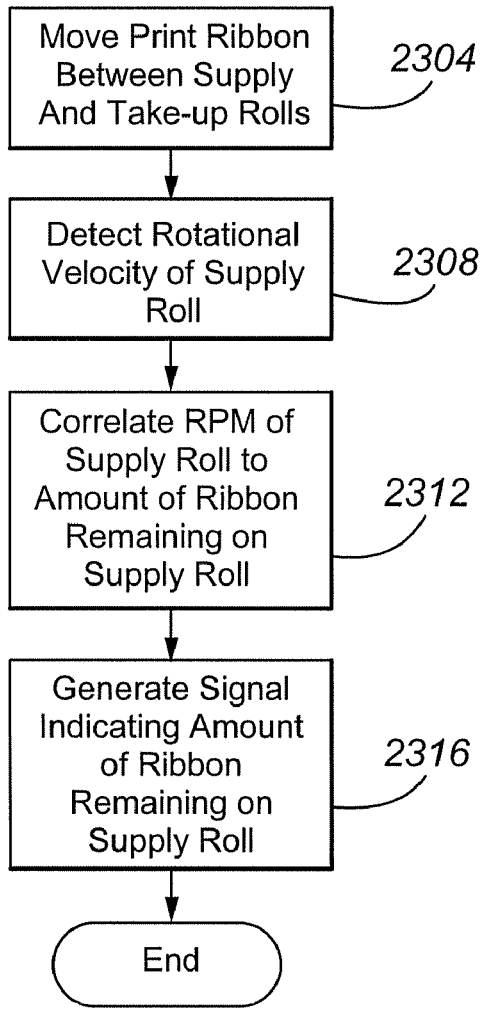
FIG. 23 is a flowchart depicting aspects of the operation of a circuit for determining print ribbon usage in accordance with embodiments of the present invention.

Aspects of the operation of a print ribbon usage sensor system 1928 in accordance with embodiments of the present invention are illustrated in FIG. 23. Initially, the print ribbon 1408 is moved between the supply roll 1412 and the take-up roll 1416 (step 2304). As the ribbon is moved, the rotational velocity or rpm of the supply roll 1412 is detected (step 2308). For example, the frequency at which light passed through an optical encoder rotating with the supply roll 1412 is detected in order to determine the rpm at which the supply roll 1412 is rotating. At step 2312, the rpm of the supply roll 1412 is correlated to the amount of print ribbon 1408 remaining on the supply roll 1412. In particular, because the rate at which the print ribbon 1408 is moved past the print head 1206 is controlled by the media 1404 and the platen 1012, the linear velocity of the print ribbon 1408 is known. The rpm of the supply roll 1412 for a given linear velocity of the print ribbon is a function of the diameter of the supply roll 1412, which is determined by the amount of print ribbon 1408 remaining in the supply roll 1412. Accordingly, the diameter of the supply roll 1412 and therefore the amount of print ribbon 1408 remaining in the supply roll 1412 can be determined. This determination can be made by the execution of firmware stored in the memory 1912 by the processor 1908 in response to rpm information provided by the tachometer 2212. More particularly, this determination can be made by executing an algorithm for calculating the amount or print ribbon 1408 remaining, or by applying the detected print ribbon supply roll 1412 rpm to a look-up table stored in memory 1912 or 1916 to obtain the amount of print ribbon 1408 remaining on the supply roll 1412. The processor 1908 can then cause a signal indicating the amount of print ribbon 1408 remaining in the supply roll 1412 to be generated (step 2316). This signal can then be delivered to a user, for example through an output 132 provided by the user interface assembly 124.

Figure 24:
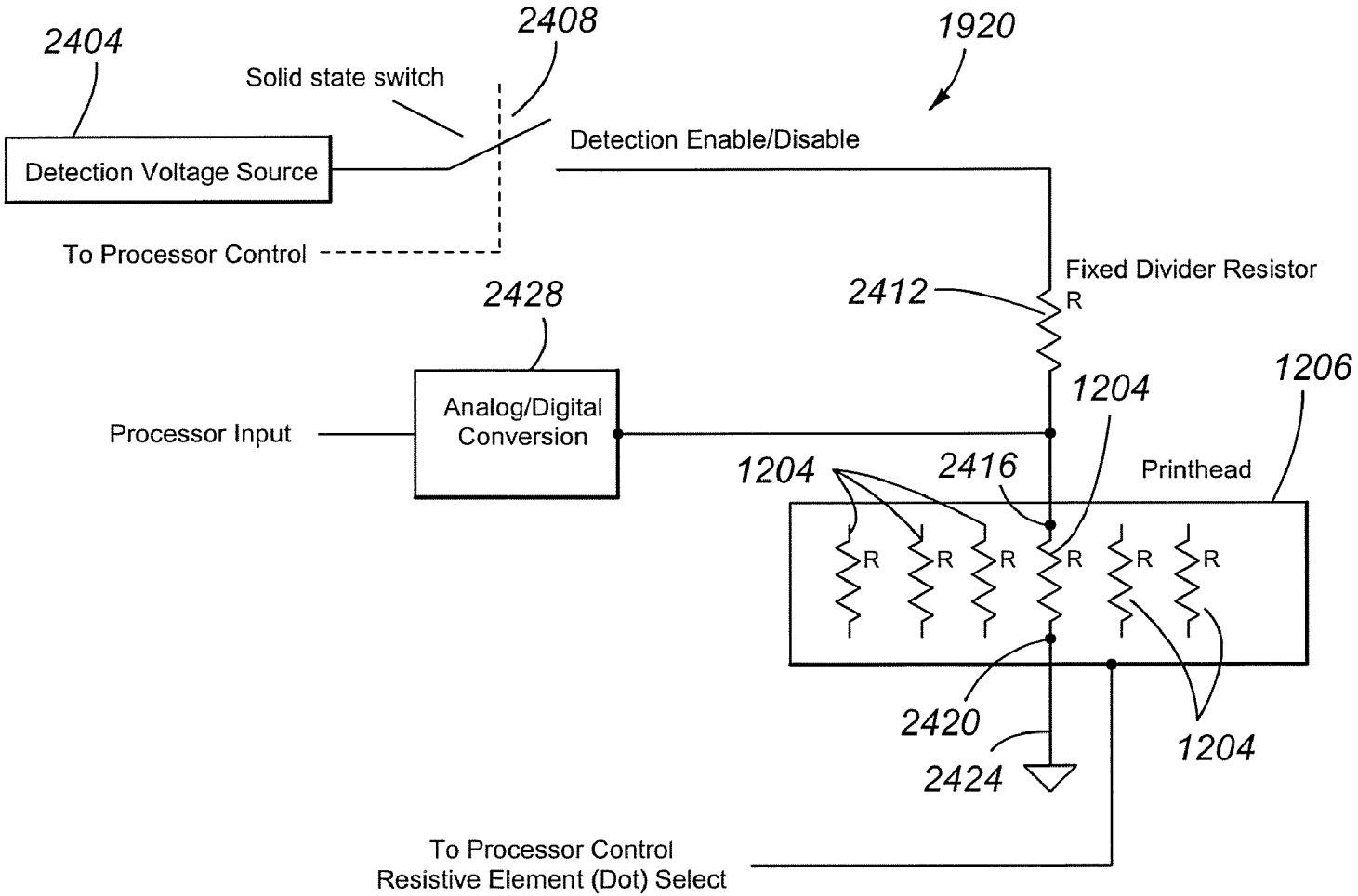
FIG. 24 is a schematic depiction of components of a circuit for detecting a condition of printer elements in accordance with embodiments of the present invention.

Components that may be included in a print head 1206 element 1204 detection system 1920 in accordance with embodiments of the present invention are depicted in FIG. 24. A detection voltage source 2404 is associated with a switch 2408 for selectively providing a detection voltage. The switch 2408 may comprise a solid-state switch operated under the control of the processor 1908. The output from the detection voltage source 2404 is provided to a first node 2416 of a selected print element 1204 via a fixed divider resistor 2412, and a second node 2420 of the selected print element 1204 is connected to ground 2424. The particular print element 1204 to which the voltage is supplied may be selected by the processor 1908, for example through control by the processor 1908 of a multiplexer. The voltage at the first node 2416 of the selected print element 1204, between the divider resistor 2412 and the selected print element 1204 is converted into a digital voltage signal by an analog to digital converter 2428, and provided to the processor 1908 as an input. As can be appreciated by one of skill in the art, the electrical resistance of the selected print element 1204 can be determined from the known detection voltage provided by the detection voltage source 2404, the known resistance value of the fixed divider resistor 2412, and the voltage at the input 2416 to the print element 1204.

Information regarding the resistance of individual print elements 1204 can be used to determine the condition of the print elements 1204. In particular, a print element 1204 that is determined to have a resistance that is higher than normal, and that therefore transmits less current than normal, may be identified as a weak print element 1204. A print element that appears as an open circuit (i.e. that has an essentially infinite resistance) can be identified as having failed completely. By identifying weak or failed print elements 1204, remedial action can be taken, including remedial action that does not require immediate replacement of the print head 1206 and/or the print head sub-assembly 1016. For example, an adjustment may be made to the position of printed output on a piece of media 1404, so that use of a weak or failed print element 1204 is avoided. As another example, a print element 1204 that is identified as weak can be strobed with a longer on-time duration than normal print elements 1204 in order to compensate for the lower energy transfer of the weak print element. Such remedial actions can allow acceptable output to be achieved even where individual print elements 1204 in a print head 1206 have failed, allowing the effective service life of the print head 1206 and/or the print head sub-assembly 1016 to be extended.

Figure 25:
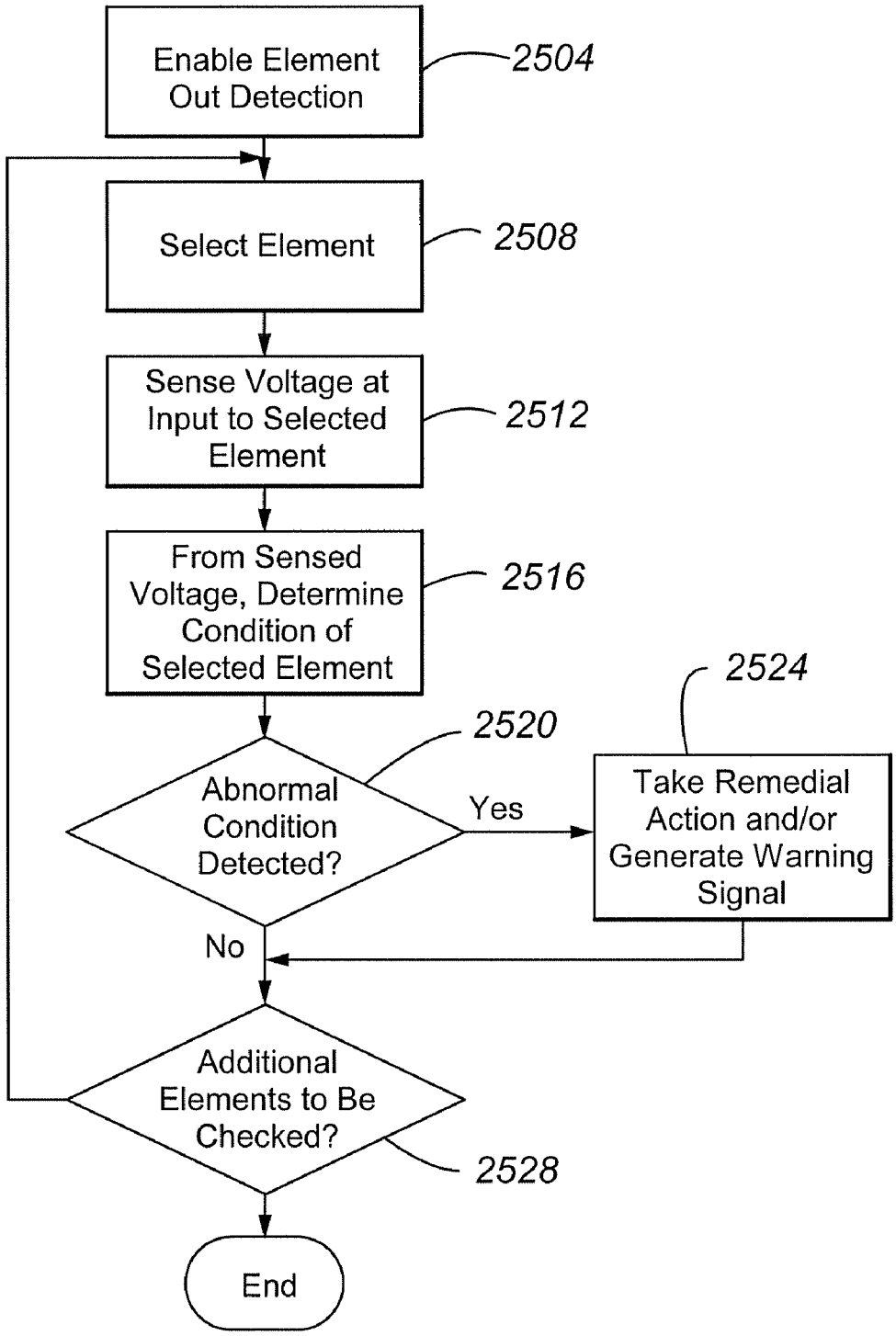
FIG. 25 is a flowchart depicting aspects of the operation of a circuit for detecting a condition of printer elements in accordance with embodiments of the present invention.

Aspects of the operation of print head element detection system 1920 are illustrated in FIG. 25. Initially, element out detection is enabled (step 2504). An individual print element 1204 is then selected for testing (step 2508). At step 2512, the voltage at the input to the selected print element 1204 is sensed. From the sensed voltage, the condition of the selected print element 1204 is determined (step 2516). If an abnormal condition, such as a high resistance value, is detected at step 2520, the process proceeds to step 2524, and remedial action is taken and/or a warning signal is generated. After determining the condition of the selected print element 1204 and taking any remedial action that is indicated and/or generating a warning signal, a determination is made as to whether additional print elements 1204 remain to be checked (step 2528). If print elements 1204 remain to be checked, the process may return to step 2508. If no print elements 1204 remain to be checked, the process may end.

The foregoing discussion of the invention has been presented for purposes of illustration and description. Furthermore, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such, or in other embodiments, and with the various modifications required by their particular application or use of the invention. It is intended that the appended claims be construed to include alternative embodiments to the extent permitted by the prior art.

What is claimed is:

1. A thermal printer, comprising:

a printer assembly, wherein a media path is established through the printer assembly, the printer assembly including:

a light source arrayed along a first line transverse to the media path and located on a first side of the media path;

an optical receiver on a second side of the media path, wherein a location of the optical receiver along a second line transverse to the media path can be selected by a user, wherein light from a first one of the plurality of optical sources is incident on the optical receiver with the optical receiver in a first location along the second line, and wherein light from a second one of the plurality of optical sources is incident on the optical receiver with the optical receiver in a second location along the second line.

2. The printer of claim 1, wherein the light source comprises a plurality of optical sources, and wherein the location of the plurality of optical sources along the first line transverse to the media path is fixed.

3. The printer of claim 2, further comprising:

first print media having a first width loaded in the printer, wherein light from a first one of the plurality of optical sources passes through the first print media and is incident on the optical receiver with the optical receiver in the first location along the second line.

4. The printer of claim 3, wherein an intensity of light from any of the optical sources can be varied.

5. The printer of claim 4, further comprising:

a controller, wherein information related to an intensity of light received at the optical receiver is communicated to the controller.

6. The printer of claim 5, wherein an intensity of light produced by a selected one of the optical sources is controlled by the controller.

7. The printer of claim 5, wherein the print media includes index marks, wherein the index marks are at a first distance from an edge of the print media, and wherein with the optical receiver in the first position along the second line light from the first one of the plurality of optical sources passes through the print media in an area that includes the first distance from the edge of the print media.

8. The printer of claim 2, wherein the plurality of optical sources comprise a plurality of focused light emitting diodes.

9. The printer of claim 2, wherein the plurality of optical sources arrayed in a first line extend across at least one-half the width of the media path.

10. The printer of claim 9, wherein the optical receiver can be placed in a location opposite any one of the plurality of optical sources.

11. The printer of claim 2, wherein the plurality of optical sources arrayed in a first line extend across the entire width of the media path.

12. The printer of claim 11, wherein the optical receiver can be placed in a location opposite any one of the plurality of optical sources.

13. The printer of claim 1, the printer assembly further comprising:

a channel, wherein the optical receiver can be moved along the channel to a selected location.

14. A method for determining a status of print media in a printer, comprising:

adjusting a location of an optical sensor with respect to the width of a media path through the printer, wherein adjusting the location includes moving the optical sensor to a first location along the width of the media path through the printer;

generating light from at least one of a plurality of optical sources, wherein a location of the plurality of optical sources with respect to the width of the media path through the printer is fixed;

receiving light from a first one of the plurality of optical sources at the optical sensor with the optical sensor in the first location.

15. The method of claim 14, wherein light from a second one of the plurality of optical sources is not received at the optical sensor when the optical sensor is in the first location.

16. The method of claim 14, further comprising:

moving the optical sensor to a second location along the width of the media path through the printer;

generating light from at least first and second of the plurality of optical sources;

receiving light from a second one of the plurality of sources at the optical sensor when the optical sensor is in the second location.

17. The method of claim 14, further comprising:

in response to detecting light of a low intensity at the optical sensor, generating an index signal; and in response to detecting light of a high intensity at the optical sensor, generating a media out signal.

18. The method of claim 14, further comprising:

determining an intensity of the light received at the optical sensor;

adjusting an intensity of the light generated by the at least one of the plurality of optical sources in response to the determined intensity of the light received at the optical sensor.

19. A system for detecting a status of print media loaded in a printer, comprising:

means for generating optical energy extending across at least a portion of a media path from a first edge of the media path to a point at or towards a second edge of the media path;

means for receiving optical energy, wherein a location of the means for receiving optical energy is adjustable within a range from at least the first edge of the media path to the point at or towards the second edge of the media path.

20. The system of claim 19, wherein the means for generating optical energy comprises a plurality of focused sources.

* * * * *